US008804296B2

(12) United States Patent
Honer et al.

(10) Patent No.: US 8,804,296 B2
(45) **Date of Patent: *Aug. 12, 2014**

(54) SYSTEM AND METHOD FOR IN-SITU CONDITIONING OF EMITTER ELECTRODE WITH SILVER

(75) Inventors: Kenneth Honer, Santa Clara, CA (US); Guilian Gao, San Jose, CA (US); Matthew Schwiebert, Cupertino, CA (US); Nels Jewell-Larsen, San Jose, CA (US)

(73) Assignee: Panasonic Precision Devices Co., Ltd., Kumamoto (JP)

( * ) Notice: Subject to any disclaimer, the term of this patent is extended or adjusted under 35 U.S.C. 154(b) by 80 days.

This patent is subject to a terminal disclaimer.

(21) Appl. No.: 13/602,256

(22) Filed: Sep. 3, 2012

(65) Prior Publication Data

US 2013/0021715 A1 Jan. 24, 2013

Related U.S. Application Data

(63) Continuation-in-part of application No. 12/771,967, filed on Apr. 30, 2010, now Pat. No. 8,482,898, and a continuation-in-part of application No. 12/820,009, filed on Jun. 21, 2010, now Pat. No. 8,405,951, and a continuation-in-part of application No. 12/819,966, filed on Jun. 21, 2010.

(60) Provisional application No. 61/652,812, filed on May 29, 2012, provisional application No. 61/530,954, filed on Sep. 3, 2011, provisional application No. 61/582,305, filed on Dec. 31, 2011.

(51) Int. Cl.
*H05F 3/00* (2006.01)

(52) U.S. Cl.
USPC ..... 361/225

(58) Field of Classification Search
USPC ..... 361/225
See application file for complete search history.

(56) References Cited

U.S. PATENT DOCUMENTS 8,405,951 B2 * 3/2013 Schwiebert et al. ..... 361/230

* cited by examiner

*Primary Examiner* — Stephen W Jackson
(74) *Attorney, Agent, or Firm* — Panasonic Patent Center

(57) ABSTRACT

Cleaning and/or conditioning electrode surfaces can provide significant performance and operational benefits in EHD devices. In particular, conditioning of emitter electrode surfaces with silver (Ag), silver compositions or silver preparations applied in situ at successive times throughout the operating lifetime of an EHD air mover has been found to significantly reduce ozone production. Structures and techniques are described for in situ conditioning electrode surfaces and, in particular, emitter electrode surfaces of an EHD device such as an air mover or precipitator, with a conditioning material that includes silver.

72 Claims, 14 Drawing Sheets

SYSTEM AND METHOD FOR IN-SITU CONDITIONING OF EMITTER ELECTRODE WITH SILVER

CROSS-REFERENCE TO RELATED APPLICATION(S)

The present application claims benefit of U.S. Provisional Application Nos. 61/582,305, filed Dec. 31, 2011, 61/530,954, filed Sep. 3, 2011, and 61/652,812, filed May 29, 2012. The present application is also a continuation-in-part of U.S. application Ser. No. 12/771,967, filed Apr. 30, 2010, entitled "ELECTRODE CONDITIONING IN AN ELECTROHYDRODYNAMIC FLUID ACCELERATOR DEVICE" and naming Honer, Gao and Jewell-Larsen as inventors. The present application is also a continuation-in-part of U.S. application Ser. No. 12/820,009, filed Jun. 21, 2010, entitled "CLEANING MECHANISM WITH TANDEM MOVEMENT OVER EMITTER AND COLLECTOR SURFACES" and naming Jewell-Larsen, Honer and Schwiebert as inventors. The present application is also a continuation-in-part of U.S. application Ser. No. 12/819,966, filed Jun. 21, 2010, entitled "GRANULAR ABRASIVE CLEANING OF AN EMITTER WIRE" and naming Gao, Jewell-Larsen and Tseng as inventors. Each of the foregoing applications is incorporated herein by reference in its respective entirety.

BACKGROUND

1. Field of the Invention

This application relates generally to in situ conditioning of electrodes in electrohydrodynamic (EHD) or electrostatic fluid handling devices such as EHD air movers.

2. Related Art

Many modern electronic devices (including desktop and laptop computers, all-in-one computers, televisions, video displays and projectors) employ forced air flow as part of a thermal management solution. Mechanical air movers such as fans or blowers have conventionally been employed in many such devices. However, in some applications and devices, mechanical air mover operation may result in undesirable levels of noise or vibration that may degrade the user experience. In some cases, physical scale or flow paths that would otherwise be necessary to accommodate a mechanical air mover may be incompatible with, or unacceptably limit, the design, scale or form factor of a particular design. Worse still, at the extremely thin device form factors popular in certain consumer electronics (e.g., laptops, pad-type computers, televisions, smartphones, book readers and media players), mechanical air mover designs (if even accommodatable) tend to exhibit poor cooling efficiencies. As a result, battery life may be adversely affected or, as a practical matter, device performance throttled to a level compatible with passive cooling.

Technologies have been developed that employ electric fields and principles of ionic movement of a fluid to motivate air flow. Devices that operate based on such principles are variously referred to in the literature as ionic wind machines, electric wind machines, corona wind pumps, electro-fluid-dynamics (EFD) devices, electrohydrodynamic (EHD) thrusters and EHD gas pumps. Some aspects of the technology have been exploited in devices referred to as electrostatic air cleaners or electrostatic precipitators and, indeed, some practical large scale device applications of the technology date back to the early 1900s. More recently, researchers have considered the utility of EHD air movers as part of a thermal management solution in consumer electronics devices. See generally, N. E. Jewell-Larsen, H. Ran, Y. Zhang, M. Schwiebert and K. A. Honer, *Electrohydrodynamic (EHD) Cooled Laptop*, in proceedings of 25*th Annual Semiconductor Thermal Measurement and Management Symposium* (March 2009).

In some cases, an ion flow or EHD air mover may improve cooling efficiency and thermal management in some devices and/or applications, while reducing noise, vibration and power consumption. Likewise, EHD air mover designs may provide or facilitate systems or devices that have reduced overall device lifetime costs, device size or volume, and/or improved electronic device performance or user experience.

Ozone ($0_3$), while naturally occurring, can also be produced during operation of various electronics devices including EHD devices, photocopiers, laser printers and electrostatic air cleaners, and by certain kinds of electric motors and generators, etc. At high concentrations, ozone can be undesirable and, accordingly, techniques to reduce ozone concentrations are desired. Indeed, techniques have been developed to catalytically or reactively break down ozone ($O_3$) into the more stable diatomic molecular form ($O_2$) of oxygen. See e.g., U.S. Pat. No. 6,603,268 to Lee and U.S. Patent Application Publication 2010-0116469, naming Jewell Larsen et al. as inventors, each of which is commonly-owned by the assignee of the present application.

Improved techniques for ozone management and/or abatement are desired.

SUMMARY

It has been discovered that cleaning and otherwise conditioning electrode surfaces can provide significant performance and operational benefits in EHD devices. In particular, conditioning of emitter electrode surfaces with silver (Ag), silver compositions or silver preparations applied in situ at successive times throughout the operating lifetime of an EHD air mover has been found to significantly reduce ozone production, in some cases by 50% or more. Structures and techniques are described for in situ conditioning electrode surfaces and, in particular, emitter electrode surfaces of an EHD device such as an air mover or precipitator, with a conditioning material that includes silver.

In some embodiments in accordance with the present invention, an apparatus includes an electrohydrodynamic (EHD) device that includes an emitter electrode energizable to motivate ion flow and a conditioning surface to frictionally engage the emitter electrode. The conditioning surface and a frictionally engaged surface of the emitter electrode are movable relative to one another to, at successive times throughout the operating life of the apparatus, deposit a conditioning material comprising silver on the frictionally engaged surface of the emitter electrode.

In some cases, the conditioning material comprising silver includes one or more of elemental silver, an oxide of silver, an alloy of silver and an organometallic silver compound. In some cases, conditioning material comprising silver further includes a material selected to at least partially mitigate at least one of electrode erosion, corrosion, oxidation, silica adhesion and dendrite formation. In some cases, the conditioning material comprising silver further includes graphite. In some cases, the conditioning material comprising silver deposited on the emitter electrode at the successive times throughout the operating life of the apparatus constitutes a consumable ozone reducer.

In some embodiments, the emitter electrode includes at least one elongate emitter wire. In some embodiments, positioning and the relative movement of the conditioning surface and the elongate wire with respect to one another provide elastic deformation of the elongate emitter wire at a point of the frictional engagement. the conditioning surface includes a body of the conditioning material at least partially conformal with a surface of the elongate emitter wire.

In some embodiments, the apparatus further includes one or more additional conditioning surfaces positioned for frictional engagement with respective portions of the surface of the emitter electrode. In some embodiments, the apparatus further includes a carriage to which the conditioning surface is affixed; and a drive mechanism operably coupled to the carriage to cause the conditioning surface to transit at least a portion of the emitter electrode. In some embodiments, the apparatus further includes a controller operable to trigger movement, at the successive times, of one of the conditioning surface and the emitter electrode relative to the other.

In some embodiments, the EHD device includes one or more collector electrodes and is energizable to motivate air flow. In some embodiments, the apparatus further includes a heat sink, wherein the EHD device is configured to motivate the air flow past the heat sink. In some embodiments, the apparatus is packaged as one of a laptop computer, a handheld electronic device and a video display, wherein the EHD device is configured to provide the laptop computer, handheld electronic device or video display with ventilating air flow. The conditioning material comprising silver deposited on the emitter electrode at the successive times throughout the operating life of the apparatus constitutes a consumable ozone reducing material. In some embodiments, the EHD device includes one or more collector electrodes and is energizable to precipitate particulates from an air flow.

In some embodiments in accordance with the present invention, a method of managing ozone in an electrohydrodynamic (EHD) device includes (i) energizing an emitter electrode of the EHD device to motivate ion flow; and (ii) at successive times throughout the operating life of the apparatus and in situ, moving a conditioning surface and a frictionally engaged surface of the emitter electrode relative to one another to deposit a consumable conditioning material comprising silver on the frictionally engaged surface of the emitter electrode.

In some cases, the consumable conditioning material comprising silver includes one or more of elemental silver, an oxide of silver, an alloy of silver and an organometallic silver compound. In some cases, the deposited consumable conditioning material comprising silver further includes a material selected to at least partially mitigate at least one of electrode erosion, corrosion, oxidation, silica adhesion and dendrite formation. In some cases, the deposited consumable conditioning material comprising silver further includes graphite.

In some embodiments, the method further includes, at the successive times, triggering the movement based on one or more of an event and sensed or detected condition. In some cases, the triggering event is or corresponds to a power or thermal management event. In some cases, the triggering event is an timed or scheduled event. In some cases, the sensed or detected condition is indicative of electrode arcing. In some cases, the sensed or detected condition is indicative of accumulated detrimental material on the emitter electrode.

In some embodiments, the method further includes, at least during the movement, de-energizing the emitter electrode. In some embodiments, the method further includes, at the successive times throughout the operating life of the apparatus, causing a carriage to which the conditioning surface is affixed to transit at least a portion of the emitter electrode. In some cases, the method further includes, at the successive times throughout the operating life of the apparatus, transiting a cleaning surface affixed to the carriage and in frictional engagement with a collector electrode of the EHD device along a portion of the collector electrode to remove at least some detrimental material therefrom.

In some embodiments, the emitter electrode includes at least one elongate emitter wire; and the method further includes, in correspondence with the relative movement of the conditioning surface and the emitter electrode with respect to one another, elastically deforming the elongate emitter wire at a point of the frictional engagement.

In some embodiments, the method further includes motivating air flow using the EHD device. In some embodiments, the method further includes precipitating particulates from an air flow using the EHD device.

In some embodiments in accordance with the present invention, a method of making an electronic device product capable of renewing in situ a consumable ozone reducing material to at least partially abate ozone otherwise produced during operation of the electronic device product includes the following: (i) tensioning an emitter wire energizable to motivate ion flow; (ii) positioning at least one conditioning surface of a carriage to frictionally engage the emitter wire and to, when transited along the emitter wire, deposit a conditioning material comprising silver on the frictionally engaged surface of the emitter wire; and (iii) mechanically coupling the carriage to a drive mechanism operable, at successive times throughout the operating life of the electronic device product, to transit the conditioning surface along the emitter wire.

In some embodiments, the method further includes mechanically biasing the conditioning surface to elastic deform the emitter wire in correspondence with transit therealong. In some embodiments, the method further includes electrically coupling the emitter wire and at least one collector electrode proximate thereto to opposing supply voltage terminals. In some embodiments, the method further includes providing the tensioned emitter wire, the frictionally engaged conditioning surface and the mechanically coupled drive mechanism as an electrohydrodynamic (EHD) device subassembly-type electronic device product.

In some embodiments, the method further includes introducing an electrohydrodynamic (EHD) air mover device subassembly comprising the tensioned emitter wire, the frictionally engaged conditioning surface and the mechanically coupled drive mechanism into the electronic device product; and electrically coupling a power or thermal management system of the electronic device product to a controller operable to trigger the drive mechanism at the successive times throughout the operating life of the electronic device product.

In some cases, the conditioning material comprising silver includes one or more of elemental silver, an oxide of silver, an alloy of silver and an organometallic silver compound. In some cases, the conditioning material comprising silver further includes graphite.

In some embodiments in accordance with the present invention, an apparatus includes an electrohydrodynamic (EHD) fluid mover that includes emitter and collector electrodes energizable to motivate fluid flow therebetween; and a conditioning mechanism operable to, at successive times throughout the operating life of the apparatus, apply a consumable ozone catalyst to a surface of the emitter electrode.

In some cases, the consumable ozone catalyst comprises silver. In some cases, the consumable ozone catalyst is applied via wearing of a solid material in frictional contact with the emitter during movement of at least one of the emitter electrode and the conditioning mechanism. In some cases, the consumable ozone catalyst is worn from one of a series of contours arranged to induce undulation in the emitter electrode during application of the consumable ozone catalyst. In some cases, at least one of the contours is defined by a blade comprising silver.

In some cases, the conditioning mechanism further applies a conditioning material selected to at least partially mitigate at least one of emitter electrode surface erosion, corrosion, oxidation, silica adhesion, dendrite formation and mechanical adhesion of other detrimental material.

In some cases, the conditioning mechanism includes at least one of a wiper, brush, squeegee and pad configured to remove detrimental materials built up on at least one of the electrodes. In some cases, the consumable ozone catalyst is applied on the emitter electrode in situ via movement of one of the conditioning mechanism and the emitter electrode. In some cases, the conditioning mechanism is configured to induce two or more undulations in the emitter electrode. In some cases, the conditioning mechanism is further operable to remove debris accumulated on the collector electrodes.

In some cases, the the emitter electrode is configured as an endless loop trained about a drive pulley. In some cases, the emitter electrode is configured to travel between a supply spool and a take-up spool.

In some cases, the conditioning mechanism defines complementary surfaces for deflecting the emitter electrode into a controlled bend. In some cases, the complementary surfaces are configured to induce multiple undulations in the emitter electrode such that controlled bending stress in the emitter electrode contributes to break up brittle silica deposits on the emitter electrode. In some cases, the complementary surfaces themselves include undulations for inducing controlled bending stress in the emitter electrode to break up brittle silica deposits on the emitter electrode.

In some cases, the conditioning mechanism includes a frictional cleaning surface engageable with the emitter electrode. In some cases, the frictional cleaning surface comprises a wearable material comprising silver. In some cases, the frictional cleaning surface comprises one of a wiper, blade, and pad comprising silver.

In some cases, the conditioning mechanism comprises one or more surface profiles configured to provide frictional cleaning and deflection of the emitter electrode. In some cases, the emitter electrode and the collector electrodes constitute at least a portion of a thermal management assembly thermally coupled to a heat dissipating device in an electronic device.

In some embodiments of the present invention(s), a method for conditioning an electrode includes operating an electrohydrodynamic (EHD) fluid mover that includes emitter and collector electrodes energizable to motivate fluid flow therebetween; operating a conditioning mechanism at successive times between operation of the EHD fluid mover; and applying in situ, during the operating of the conditioning mechanism, a consumable ozone catalyst to a surface of the emitter electrode. In some cases, the consumable ozone catalyst comprises silver.

In some embodiments, operating the conditioning mechanism includes transiting the emitter electrode in frictional contact with a wearable cleaning surface comprising the consumable ozone catalyst. In some embodiments, operating the conditioning mechanism includes transiting a wearable cleaning surface comprising the consumable ozone catalyst in frictional contact with the emitter electrode.

In some embodiments, the method further includes moving at least one of the conditioning mechanism and the emitter electrode to thereby remove detrimental material from the emitter electrode. In some embodiments, the method further includes applying a conditioning material selected to at least partially mitigate at least one of emitter electrode surface erosion, corrosion, oxidation and dendrite formation. In some cases, the conditioning material includes at least one of silver, palladium, platinum, manganese, nickel, zirconium, titanium, tungsten, aluminum, and a respective oxide or alloy thereof.

In some embodiments, the applying of the consumable ozone catalyst is performed when the emitter electrode is not energized. In some embodiments, the applying is initiated by a controller based upon one or more of an imposed voltage level, a measured electrical potential, determination of the presence of a level of contamination by optical means, detection of an event and detection of a performance parameter.

In some embodiments, the method further includes elastically deforming the emitter electrode to remove undesirable material accumulated on the surface thereof. In some embodiments, the consumable ozone catalyst is applied on the electrode in situ via movement of one of the cleaning device and the electrode with respect to the other under control of a drive mechanism.

These and other embodiments will be understood with reference to the description herein, the drawings and the appended claims.

BRIEF DESCRIPTION OF THE DRAWINGS

The present invention may be better understood, and its numerous objects, features, and advantages made apparent to those skilled in the art by referencing the accompanying drawings.

FIG. 7B is a cross-sectional view of the cleaning blocks of FIG. 7A.

The use of the same reference symbols in different drawings indicates similar or identical items.

DESCRIPTION OF THE PREFERRED EMBODIMENT(S)

Devices built using the principle of ionic movement of a fluid are variously referred to in the literature as ionic wind machines, electric wind machines, corona wind pumps, electro-fluid-dynamics (EFD) devices, electrostatic fluid accelerators (EFAs), electrohydrodynamic (EHD) thrusters and EHD gas pumps. Some aspects of the technology have also been exploited in devices referred to as electrostatic air cleaners or electrostatic precipitators. In general, EHD technology uses ion flow principles to move fluids (e.g., air molecules). Basic principles of EHD fluid flow are reasonably well understood by persons of skill in the art. Accordingly, a brief illustration of ion flow using corona discharge principles in a simple two-electrode system sets the stage for the more detailed description that follows.

Figure 1A:
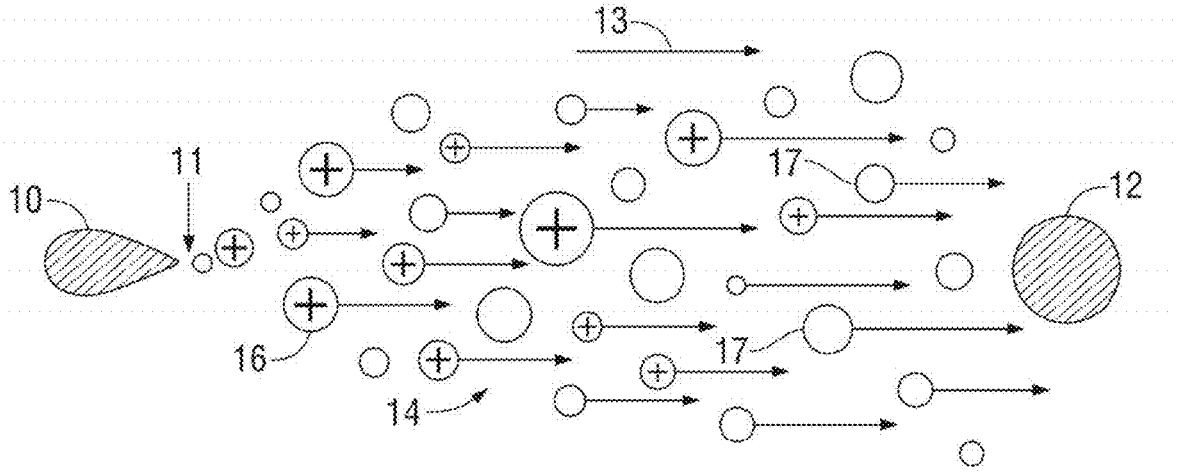
FIG. 1A is a depiction of certain basic principles of electrohydrodynamic (EHD) fluid flow.

With reference to the illustration in FIG. 1A, EHD principles include applying a high intensity electric field between a first electrode 10 (often termed the "corona electrode," the "corona discharge electrode," the "emitter electrode" or just the "emitter") and a second electrode 12. Fluid molecules, such as surrounding air molecules, near the emitter discharge region 11, become ionized and form a stream 14 of ions 16 that accelerate toward second electrode 12, colliding with neutral fluid molecules 17. During these collisions, momentum is imparted from the stream 14 of ions 16 to the neutral fluid molecules 17, inducing a corresponding movement of fluid molecules 17 in a desired fluid flow direction, denoted by arrow 13, toward second electrode 12. Second electrode 12 may be variously referred to as the "accelerating," "attracting," "target" or "collector" electrode. While stream 14 of ions 16 is attracted to, and generally neutralized by, second electrode 12, neutral fluid molecules 17 continue past second electrode 12 at a certain velocity. The movement of fluid produced by EHD principles has been variously referred to as "electric," "corona" or "ionic" wind and has been defined as the movement of gas induced by the movement of ions from the vicinity of a high voltage discharge electrode 10.

Notwithstanding the descriptive focus on corona discharge type emitter electrode configurations, persons of ordinary skill in the art will appreciate that ions may be generated by other techniques such as silent discharge, AC discharge, dielectric barrier discharge (DBD), or the like, and once generated, may, in turn, be accelerated in the presence of electrical fields to motivate fluid flow as described herein. For avoidance of doubt, emitter electrodes need not be of a corona discharge type in all embodiments. Also for avoidance of doubt, power supply voltage magnitudes, polarities and waveforms (if any) described or illustrated with respect to particular embodiments are purely illustrative and may differ for other embodiments.

Figure 1B:
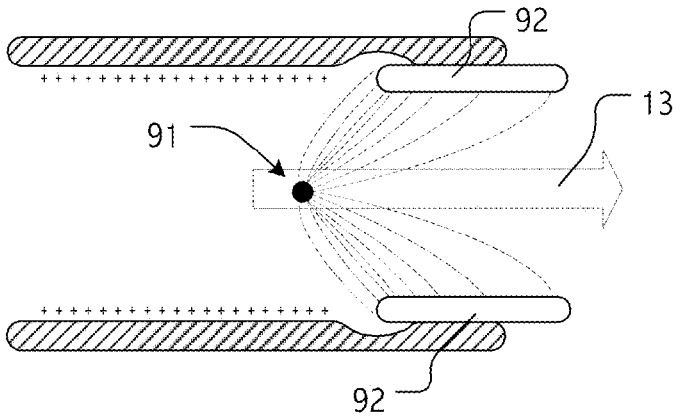
FIG. 1B depicts a side cross-sectional view of an illustrative EHD air mover device.

In general, practical EHD air mover implementations may include electrode geometries, channel designs and field shaping features, EMI shielding and/or duct work and heat transfer surfaces that have been adapted for a given application or deployment. FIG. 1B depicts a side cross-sectional view of an illustrative EHD air mover that has been developed for thin form factor consumer electronics device applications. Although embodiments in accordance with the present inventions need not employ an EHD air mover designs akin to that illustrated in FIG. 1B or as detailed elsewhere herein, persons of ordinary skill in the art will appreciate suitable adaptations of the techniques described herein to systems that include EHD air movers of alternative design(s).

Accordingly, in view of the foregoing, and without limitation, in the EHD air mover illustrated in FIG. 1B, a high intensity electric filed is established between an emitter electrode 91 and a pair of collector electrodes 92. Although power supply connections are omitted for clarity, exemplary field lines show the direction in which individual ions are accelerated to motivate a net downstream fluid flow 13.

During operation of EHD devices (including exemplary devices such as illustrated and described herein), emitter and collector materials and structures are subject to degradation, whether by erosive or accretive electrochemical processes can involve interactions (in a corona discharge region closely proximate the surface of an emitter) of a plasma, chemical constituents of an ambient fluid, surface chemistry of the emitter electrodes, and catalysis. For example, in some cases and operating environments, EHD device performance reduction or failure can be caused by gradual coating of the emitter with silica, including dendritic growth thereon. In some cases and operating environments, EHD devices can produce undesireable concentrations of ozone.

In general, electrodes (including the aforementioned emitter and collector electrodes) may be susceptible to oxidation, corona erosion, or accumulation of detrimental materials. The term "corona erosion" refers to various adverse effects from a plasma discharge environment including enhanced oxidation, and etching or sputter, particularly (though not exclusively) of emitter surfaces. In general, corona erosion can result from any plasma or ion discharge including, silent discharge, AC discharge, dielectric barrier discharge or the like.

Detrimental material such as silica dendrites, surface contaminants, particulate or other debris may accumulate or form on electrode surfaces and may decrease the performance, efficiency and lifetime of such devices. In particular, siloxane vapor breaks down in a plasma or corona environment and forms solid deposits of silica on the electrodes, e.g., emitter or collector electrode. Other detrimental materials may build up on any number of electrode surfaces. Build-up of such detrimental materials can decrease power efficiency, cause sparking or reduce spark-over voltage and contribute to device failure. In some cases, build-up of such detrimental materials, including e.g., the resulting effects on magnitude of electric fields proximate dendritic growths and/or encapsulations of otherwise desirable material compositions of the electrode surface, may contribute to undesirable levels of ozone production.

Accordingly, structures and techniques have been developed for cleaning and otherwise conditioning (EHD) electrode surfaces. In particular, conditioning of emitter electrode surfaces with silver (Ag), silver compositions or silver preparations applied in situ at successive times throughout the operating lifetime of the EHD device has been found to significantly reduce ozone production, in some cases by 50% or more. In general, structures and techniques for in situ conditioning electrode surfaces, and in particular emitter electrode surfaces of an EHD device, with a conditioning material that includes silver will be understood by persons of ordinary skill in the art having benefit of the present disclosure.

Figure 2A:
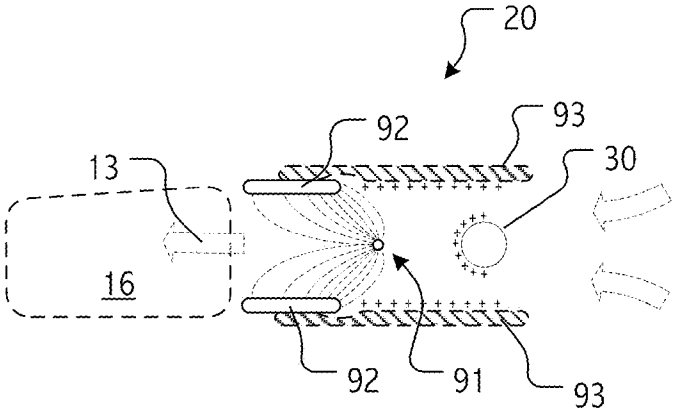
FIGS. 2A and 2B depict (in respective cross-sectional and perspective views) an EHD air mover assembly in which an upstream lead screw or worm gear driven carriage is provided to transit electrode conditioning and/or cleaning surfaces over at least a portion of an elongate, wire-type, mid-channel emitter electrode and a pair of closely-spaced elongate collector electrode surfaces.
Figure 2B:
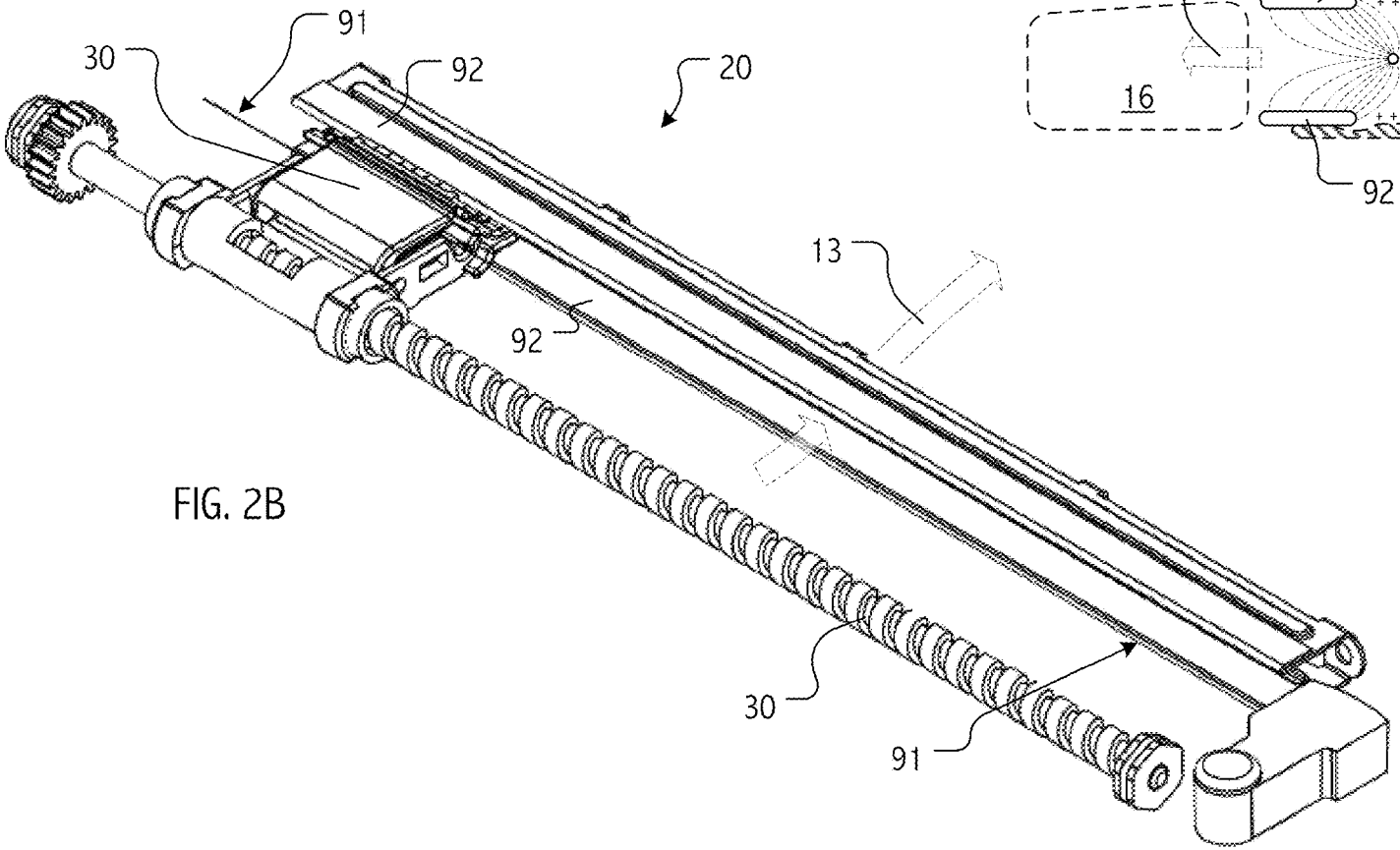

FIGS. 2A and 2B depict (in respective cross-sectional and perspective views) an EHD air mover assembly 20 in which a upstream lead screw or worm gear 30 driven carriage 32 is provided to transit electrode conditioning and/or cleaning surfaces over at least a portion of an elongate, wire-type, mid-channel emitter electrode 91 and a pair of closely-spaced elongate collector electrode surfaces 92. When energized with high voltage (typically multi-KV voltage supplied from power supply terminals that have been omitted for clarity), an ion flux from emitter electrode 91 to collector electrodes 92 is generated and air flow 13 results based on mechanisms such as previously described.

In the illustrated cross-sectional view of FIG. 2A, EHD motivated airflow 13 travels past heat transfer surface(s) 16 (in some cases, a plurality of metallic fins) that may be thermally coupled (e.g., by heat spreader, heat pipe or the like) to heat surfaces for which a thermal management solution is to be provided. Dielectric top and bottom wall surfaces at least partially define a channel through which air flow is motivated and, in the illustrated embodiment, collector electrode surfaces 92 are positioned generally thereagainst. In situ cleaning and/or conditioning of respective electrode surfaces, including in situ conditioning of emitter electrode 91 with a conditioning material that includes silver (Ag) will understood based on the description herein.

In situ Cleaning and/or Conditioning, Generally

The generalized descriptions of in situ cleaning and/or conditioning of electrode surfaces that follow will be understood relative to a variety of EHD device implementations in which such techniques may be employed. One class of such EHD device implementations includes EHD air movers such as illustrated and described above with reference to FIGS. 2A and 2B. Commonly-owned co-pending U.S. patent application Ser. No. 13/105,343, filed May 11, 2011, entitled "ELECTROHYDRODYNAMIC FLUID MOVER TECHNIQUES FOR THIN, LOW-PROFILE OR HIGH-ASPECT-RATIO ELECTRONIC DEVICES" and naming Jewell-Larsen, Honer, Goldman and Schwiebert as inventors (now published as US 2011/0292560) illustrates a further range of EHD air mover configurations that are suitable for thin, small form factor designs typical of modern consumer electronics. Application Ser. No. 13/105,343 is incorporated herein by reference for the limited purpose of illustrating and describing a range of device exploitations for some EHD air mover subassemblies in accordance with the present invention(s), together with ancillary components and subsystems such as displays, power supplies, enclosures, circuit boards, etc.

In such devices, as well as others, an elongate wire-type emitter electrode may be employed. For generality (though without loss of applicability to the EHD air mover device structures described elsewhere herein), in situ cleaning and/or conditioning may be described relative to simply an "electrode" or "electrode surface." Based on the description herein, persons of ordinary skill in the art will appreciate applications of the described structures and techniques to emitter-type electrode surfaces as well, in some cases, as collector-type electrode surfaces.

In some implementations of an EHD air mover, a cleaning or conditioning device (e.g., a wiper, pad, surface, edge or the like) may be held and/or moved against an electrode (or electrodes) with a suitable force or pressure to mechanically remove detrimental material while not abrading or otherwise damaging the electrode(s). In some cases, the electrode(s) is (are) moved past the wiper, pad, surface or edge. The wiper, pad, surface or edge may have a composition selected to be hard enough to remove the detrimental material under the selected pressure, and yet soft enough (relative to the electrode surface material) to not harm the electrode. A conditioning device (again a wiper, pad, surface, edge or the like) deposits a conditioning material on an electrode (or electrodes).

In some cases, cleaning and conditioning may each involve a distinct wiper, pad, surface or edge. In some cases, cleaning and conditioning may both be provided by a same wiper, pad, surface or edge. For example, a wiper, pad, surface or edge used for removal of detrimental material may also include a wearable bulk of conditioning material to leave a low adhesion or non stick layer on the electrode surface during the conditioning process. In some cases, the conditioning material composition may be selected to form a partially conductive layer on the electrode. In some cases, the conditioning material may be selected to at least partially mitigate erosion, corrosion, dendrite formation, oxidation and ozone.

The applied conditioning material layer may be conformal to the electrode surface or may partially coat the surface and smooth the surface. The layer may provide electrode erosion control, reduce the detrimental material and dendrite formation rate, and reduce sharp points that may cause electrode arcing. The layer may be formed of a carbon containing compound selected to inhibit contamination buildup and facilitate the removal of contamination buildup due to the generally low adhesion of carbon surfaces. The layer may include silver, silver oxide, an alloy of silver or an organometallic silver compound as an ozone catalyst or reducing material.

In various implementations, cleaning and/or conditioning may be done with a brush, rotating brush, compliant or conformal surface, or an edge such as a squeegee or wiper blade, or with a material having sufficient softness to not abrade, scratch or damage the surface of the electrode.

In some implementations, carbon may be applied during cleaning by using a wearable carbon wiper blade, thus removing detrimental materials at the same time as forming or renewing a conditioning coating. The lubricating effect of the soft carbon material (for example graphite) may also further reduce damage to the electrode during wiping and during operation under ion bombardment, e.g., in a plasma environment such as found in corona devices.

The cleaning and/or conditioning device or wiper may be formed of two or more blocks that are urged against at least part of the electrode surface. For example, in some cases, the electrode is a wire and the blocks may include graphite and/or silver inserts or layers. The blocks may be pressed towards each other on opposite sides of the wire, and the motion of the wire electrode against the blocks may wear the graphite to form a partial layer of carbon on parts of the wire. Conditioning material including silver may be likewise applied or deposited on an wire-type emitter electrode.

In a particular case, the wire may be substantially wiped and conditioned by rotating or spiraling the graphite and/or silver conditioning material bearing blocks around the circumference of the wire while travelling along the length of the wire. As wiping operations occur at selected intervals, a groove may be worn into the wearable conditioning material on the blocks, such that the blocks may eventually contact each other around the wire. The wearable conditioning portion or the entire cleaning blocks may be replaced as needed. Alternatively, in some implementations, the cleaning blocks may be compliant such that an applied pressure on the blocks causes the block to deform around the wire. Wear tolerant profiles may be provided as described in commonly-owned, co-pending U.S. patent application Ser. No. 12/828,079, filed Jun. 30, 2010, entitled "EMITTER WIRE CLEANING DEVICE WITH WEAR-TOLERANT PROFILE" (now published as US 2012/0000486).

Figure 3:
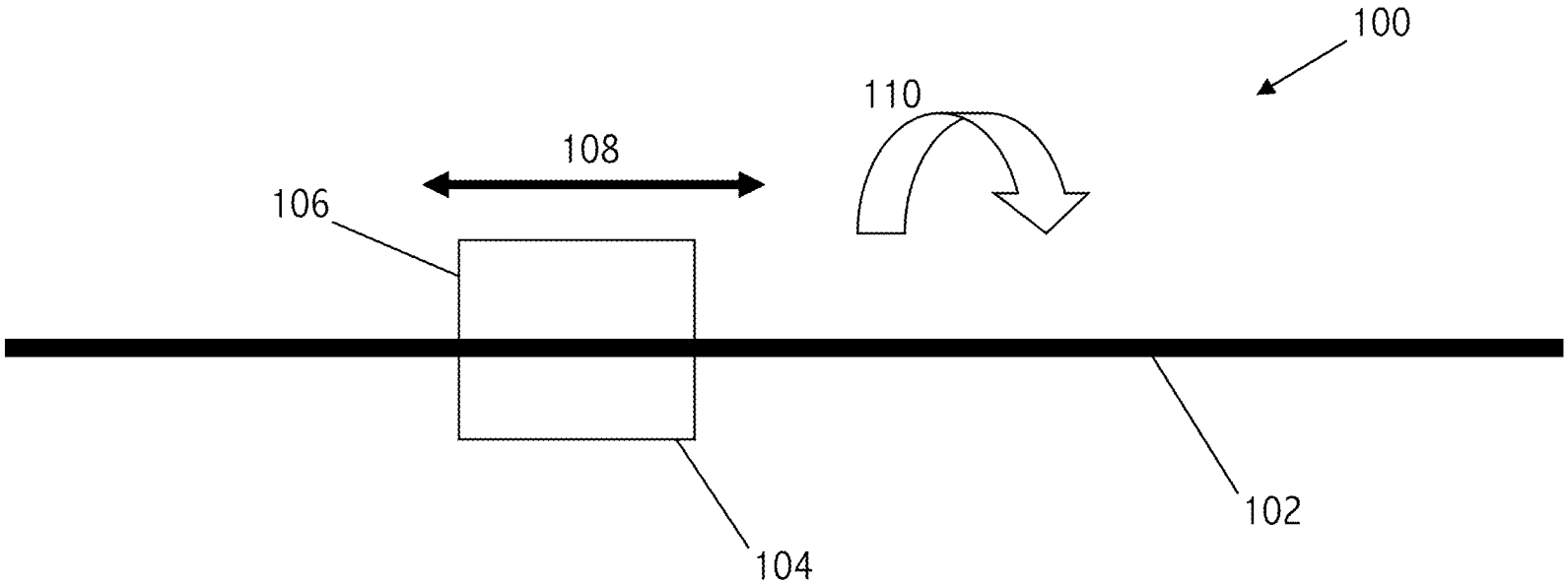
FIG. 3 depicts a side view of an electrode, such as may be employed as an emitter electrode of an EHD device, with cleaning and/or conditioning surfaces to frictionally engage therewith in accordance with some embodiments of the present invention.

With reference to FIG. 3, one implementation of a cleaning and/or conditioning system 100 includes an electrode 102 and a mechanical cleaning device or "wiper" including two opposed cleaning or conditioning blocks, 104 and 106, on opposite sides of the electrode 102. In general, embodiments are not limited to two part cleaning devices as shown in the drawing, but may include single piece sliding cleaning devices such as shuttles, beads, brushes, or multiple cleaning heads and surfaces. Likewise, the electrode is not limited to wire electrodes and may include planar electrodes, elongated electrodes and other shaped electrodes.

The cleaning device comprising portions 104/106 may be moved in contact with the electrode 102 in a linear motion 108, or a rotating motion 110, or a combination of motions, either simultaneously or sequentially. For example, cleaning blocks 104/106 may be translated or otherwise driven by a carriage moveable along a length of electrode 102, such as described elsewhere herein with reference to FIG. 2A (and emitter electrode 91) or with reference to the configurations of FIGS. 11 and 12A, 12B (and emitter electrodes 1008, thereof).

Alternatively, electrode 102 may be transited past cleaning blocks 104/106. Thus, detrimental material removal and/or electrode conditioning (collectively "cleaning/conditioning") may be accomplished by movement of either of the electrode 102 or cleaning blocks 104/106 with respect to the other. For example, electrode 102 may be an endless loop trained about a drive pulley. Alternatively, in some cases, worn or contaminated electrode may be periodically renewed by new wire lengths drawn from a supply spool and the used lengths collected on a take-up spool. In some cases, new electrode lengths may be provided by other feed mechanisms or may simply be manually replaced. A new electrode may be provided after a fixed number of cleaning cycles, after a predetermined period of use or upon detection of deterioration of performance. Thus, an actuator may be used to move at least one of the electrode and the cleaning blocks.

In some implementations, the cleaning/conditioning is performed when the electrode is not in use. Alternatively, the cleaning action may be performed continuously or at timed intervals. In some cases, conditioning or cleaning may be initiated by a controller based upon one or more of an imposed voltage level, a measured electrical potential, determination of the presence of a level of contamination by optical means, by detection of an event or performance parameter, or other methods indicating a benefit from mechanically cleaning and/or conditioning the electrode 102.

Figure 4:
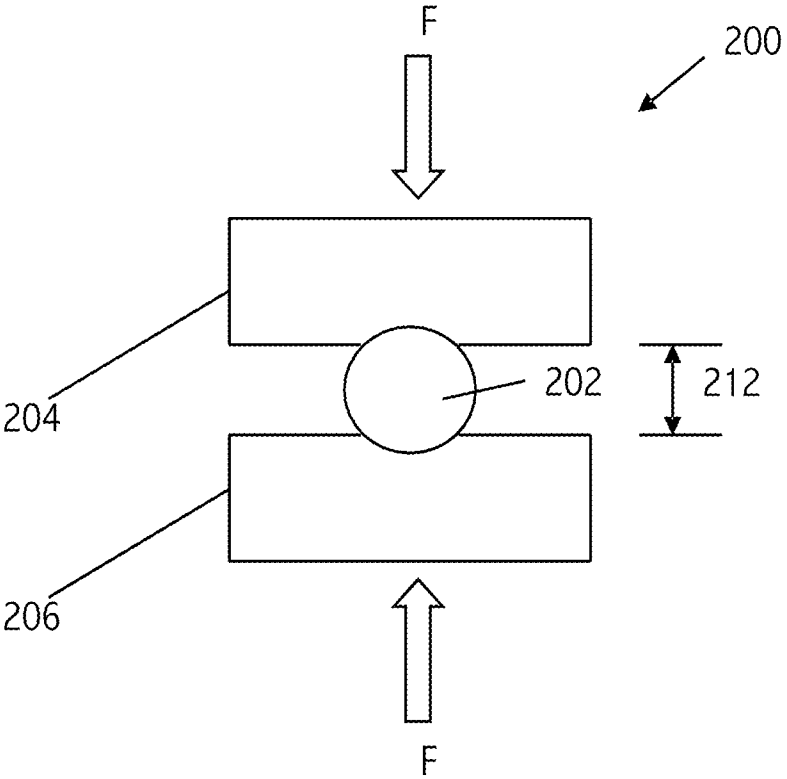
FIG. 4 illustrates an end-on cross-sectional view of an electrode (generally corresponding to that depicted in FIG. 3) with cleaning and/or conditioning surfaces to frictionally engage therewith in accordance with some embodiments of the present invention.

FIG. 4 illustrates an end-on, cross-sectional view of a cleaning system 200 with an electrode 202, with one or both of the cleaning blocks or portions 204 and 206 of a cleaning device being pressed onto the electrode 202 with an applied force F. Applied force F may be provided by springs, compressible foam, magnetic repulsion, fringing fields, solenoids, electrical repulsion, or any other means of providing a selected contact force between cleaning blocks 204/206 and electrode 202. Force F may be applied at a selected time with a selected pressure. For example, in a particular case, a foam backing plate connecting one of cleaning blocks 204/206 to a carriage or other support structure may urge the corresponding block against electrode 204 or the opposing block.

It may be seen that block 204 need not contact block 206 in the illustration. In the case of the blocks 204 and 206 being formed of a wearable or relatively soft material such as graphite, the operation of the cleaning device 200 under the pressure resulting from applied force F may result in the removal of some of the block material in the area adjacent to the electrode 202, resulting in a groove forming or deepening in the two blocks as shown. For example, cleaning blocks 204 and 206 may be separated by a spacing 212 that is reduced over time, with the blocks eventually contacting each other.

Thus, the efficacy of removal of detrimental material from or deposition of conditioning material on the surface of the electrode 202 may diminish over time. At this point the user may replace one or both of blocks 204 and 206, or any portion thereof, e.g., a wearable conditioning material insert or pad. Alternatively, block life may be prolonged, in some cases, using a compliant block material such that the applied pressure on the block causes the block to deform around the electrode.

It may be noted that moving the blocks 204 and 206 in the linear fashion shown in FIG. 3 reference numeral 108, along the length of the electrode 202 (i.e., into and out of the page in the FIG. 4 frame of reference), may not completely remove all detrimental material, debris, contamination or dendrites on the surface due to the space between the two blocks. In some cases, it may be desirable to use a circular motion 110 as in FIG. 3 in conjunction with the linear motion 108, to provide more comprehensive coverage of the electrode.

Figure 5:
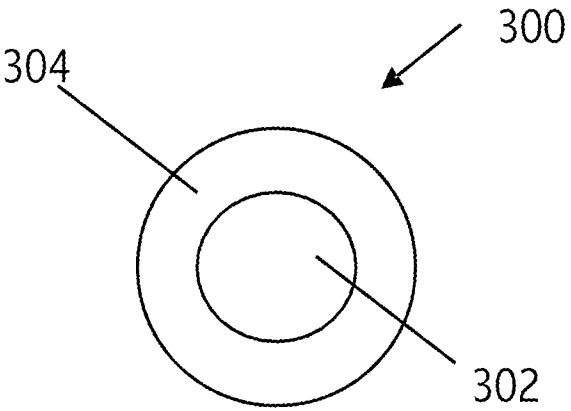
FIG. 5 illustrates an end-on cross-sectional view of an electrode with conditioning material applied thereto by operation of cleaning and/or conditioning surfaces frictionally engaged (or engageable) therewith in accordance with some embodiments of the present invention.

FIG. 5 illustrates a cross sectional view of the electrode with a carbon conditioning material coating 304 formed, for example, by a soft carbon block sliding either linearly in direction 108 of FIG. 3, or in a rotary fashion 110 of FIG. 3, around the electrode 302. In this implementation, the cleaning blocks (not specifically shown) further serve as a conditioning surface leaving a conditioning material coating 304 on the electrode 302. The coating 304 is shown as a single layer, but the invention is not so limited, and may be a plurality of layers, each one formed during sequential cleaning operations as previously discussed.

The coating 304 may be formed of multiple conditioning materials or of multiple conditioning material layers by use of multiple wiper blades, cleaning blocks and/or multiple conditioning material surfaces. In a particular case, multiple cavities or channels defined in a cleaning block retain conditioning materials for deposition on the electrode. The material of the coating may be a uniform material, multiple layers of different materials, a material formed by the combination of two different materials wiped onto the electrode 302, or a material formed by chemical action or by plasma action.

In some cases, the conditioning material sublimates from a solid phase to a vapor phase in response to heating of the conditioning material. In some implementations, the conditioning material is applied by wicking onto the electrode, for example, using capillary channels formed in a cleaning block. Alternatively, the electrode itself may wick the conditioning material from a reservoir or other source along a portion of the electrode and the cleaning blocks may further spread the conditioning material along the electrode. Such wicking and spreading may be aided by heating the electrode.

The conditioning material layer 304 provides a sacrificial layer or protective coating. The coating need not be continuous over the entirety of the operating surface of the electrode 302. In some cases, the coating may provide low adhesion or a "non stick" surface, or it may have a surface property that repels silica, which is a common material in dendrite formation. As an illustrative example, the conditioning material layer 304 may include carbon such as graphite, and may reduce adhesion of dendrites and other detrimental materials, and may reduce their formation rate as well as improve the ease of mechanically removing any contamination. Conditioning material layer 304 may serve as a sacrificial layer that is oxidized or eroded by a plasma environment. Replenishment of this sacrificial layer provides erosion protection for the underlying electrode metal, such as tungsten, or another electrode protective coating that may otherwise be eroded or thinned.

For clarity and descriptive focus, electrode 302 is presented herein primarily as an exposed electrode surface without particular regard to internal structure or metallurgy. It will be appreciated by persons of ordinary skill in the art having benefit of the present description that engineered emitter electrode structures may provide desirable levels of surface hardness, robustness to erosion and electrochemical effects in the corona, tensile strength and elastic deformability, etc. In this regard, commonly-owned co-pending U.S. patent application Ser. No. 13/302,811, filed Nov. 22, 2011, entitled "EMITTER WIRE WITH LAYERED CROSS-SECTION" and naming Gao, Jewell-Larsen and Humpston as inventors illustrates describes and further details particular emitter wire structures and metallurgy suitable for some EHD air mover embodiments. Application Ser. No. 13/105,343 is incorporated herein by reference for the limited purpose of its further description of emitter wire structures and metallurgy, which may optionally be employed in embodiments in accordance with the present invention(s).

In some implementations, the material of the layer 304 may be selected to have an ozone reduction function, e.g., to reduce ozone generated by the device. As an illustrative example, a material that includes silver (Ag) may be used to reduce ozone in an air flow. Silver may also be used to prevent silica growth.

Reapplication of the layer 304 during wiping operations may be controlled via the applied pressure and composition of the wiping surface to form a coating with a thickness approximately equal to an erosion thickness. Thus, the conditioning material layer 304 may be repeatedly eroded and reformed on the surface of electrode 302.

Figure 6:
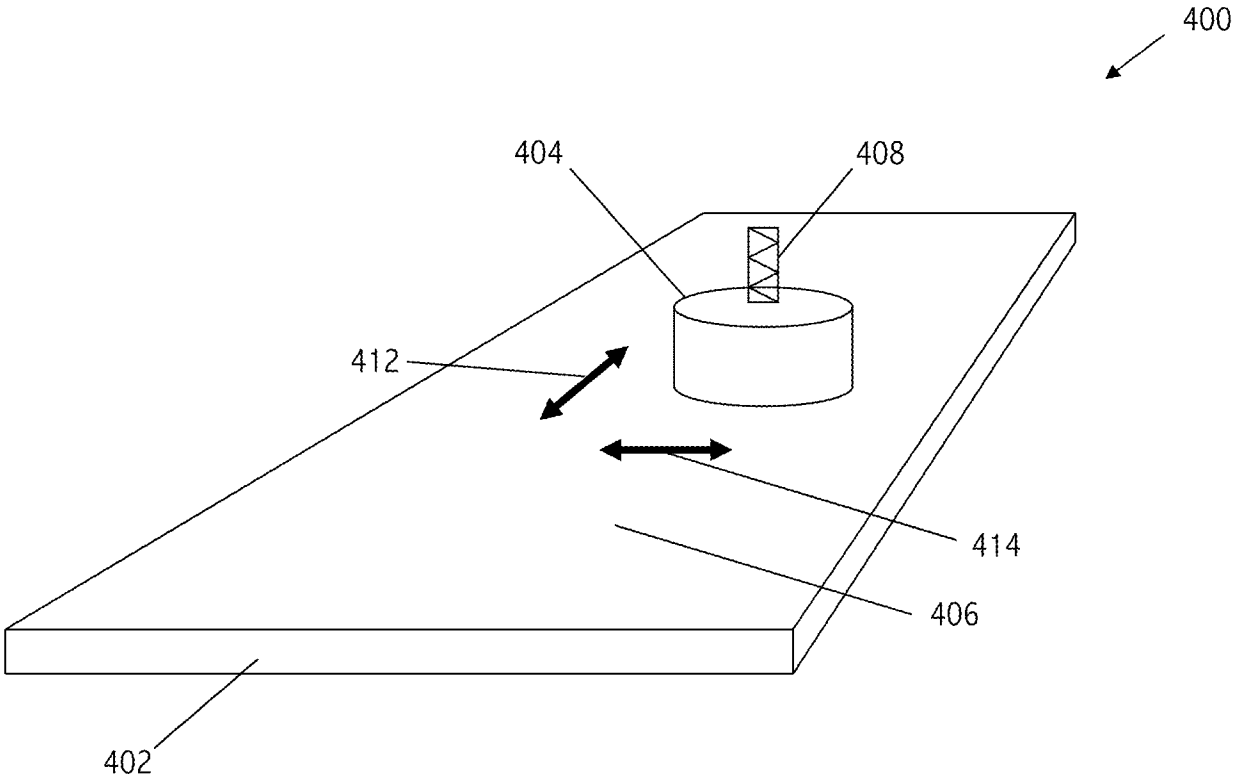
FIG. 6 depicts a generally planar electrode surface and a cleaning and/or conditioning surface frictionally engaged (or engageable) therewith in accordance with some embodiments of the present invention.

FIG. 6 illustrates a planar electrode 402 having a sliding cleaning device 404. The sliding cleaning device 404 may comprise a conditioning material, e.g., soft carbon containing material such as graphite that may deposit a layer 406 (not separately shown for simplicity of understanding) on a portion of the surface of the electrode 402. The conditioning material may be a wearable layer, e.g., a graphite pad, insert or layer. Alternatively, cleaning device 402 can comprise major components formed substantially of conditioning bulk material, e.g., a solid wearable graphite cleaning block as previously discussed.

The cleaning device 404 may have any shape and is not limited to the cylindrical shape shown. The cleaning device 404 may be removed from the surface, placed and urged against the surface of electrode 402 by a pressure device 408. The cleaning device 404 may be movable in any combination of motions 412 and 414 to cover any selected portion of the electrode 402. Various combinations of motions 412 and 414 may be linear, reciprocating, circular or elliptical. The shape of the electrode 402 is shown as planar (and is generally consistent with planar collector electrodes such as illustrated and described above with reference to FIGS. 2A and 2B), but the invention is not so limited and is adaptable to any shape of electrode.

With reference to FIGS. 7A, 7B, 8, 9 and 10, cleaning blocks can be constructed or arranged to elastically deform or deflect an electrode (e.g., a wire-type elongate emitter electrode) during cleaning, for example, via a nonlinear contour of a cleaning/conditioning block or of an electrode guide or other suitable electrode contact feature. In some implementations, the electrode is clamped between two conditioning pads or cleaning blocks, each of which define complementary surfaces for deflecting the electrode into a controlled bend. The radius of the bend is selected to avoid plastic deformation of the electrode. For example, the electrode diameter and bend radius are selected such that a ratio of the electrode radius to a bend radius does not exceed the yield strain of the electrode material. In some embodiments, the complementary surfaces can include multiple undulations inducing controlled bending stress in the electrode to break up brittle silica deposits on the electrode. Deflection of the electrode also helps maintain contact between the electrode and the conditioning pads/cleaning blocks as they wear.

Figure 7B:
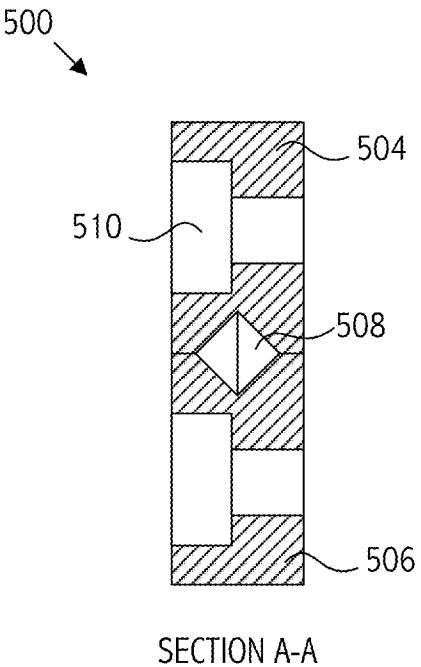
FIGS. 7A and 7B illustrate cleaning/conditioning blocks for conditioning an electrode in accordance with some embodiments of the present invention.
Figure 7A:
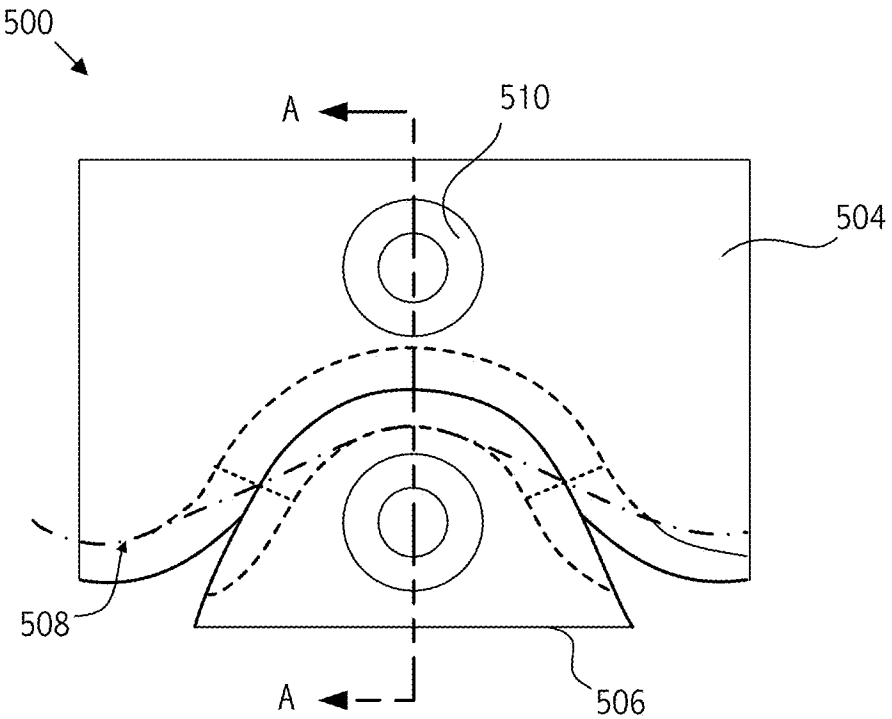

With reference to FIG. 7A and the cross-sectional view of FIG. 7B, a mechanical cleaning device or "wiper" 500 includes a first cleaning block 504 and an opposing second cleaning block 506 for contacting an electrode. Blocks 504 and 506 together define a nonlinear electrode guide 508 or path providing elastic deformation of an electrode and frictional cleaning contact on obverse electrode surfaces. During cleaning and conditioning, an electrode passes through electrode guide 508 as either the electrode or the cleaning blocks are transited past the other. Electrode guide 508 is depicted in cross-sectional view as defining a channel sized to receive an electrode therein.

In some instances, elastic deformation of the electrode can increase cleaning or conditioning efficacy or control. For example, a degree of deformation of the electrode or a degree of friction at certain points of contact may be controlled to vary cleaning and conditioning parameters. Tension in the electrode or pressure or spacing between cleaning blocks 504/506 may be variable in some cases. For example, cleaning blocks 504/506 may initially be spaced a distance apart and may then gradually move closer together and contact as the blocks wear from extended cleaning and conditioning cycles.

Cleaning blocks 504/506 may be formed of a wearable material including a conditioning material composed to reduce adhesion, reduce ozone, mitigate oxidation or otherwise mitigate adverse effects of ion bombardment or a plasma environment. In a particular implementation, blocks 504/506 are formed of a substantially sold, wearable graphite conditioning material. In some implementations, the wearable conditioning material is substantially softer than the electrode plating to avoid plating damage during cleaning/conditioning. In some cases, conditioning material compositions can include silver, platinum, manganese, palladium, nickel, or oxides or alloys of the same. In some cases, the condition composition includes carbon, organometallic materials that decompose under plasma conditions, and combinations thereof.

In some implementations, blocks 504/506 are formed of different materials or include different conditioning materials. For example, one block may bear a felt cleaning material while the other block includes a wearable graphite conditioning material. In some implementations, cleaning blocks 504/506 both include harder carbon wiping and conditioning materials. In some implementations, at least one of cleaning blocks 504/506 includes a softer wiper material, e.g., a felt pad or mohair.

Cleaning blocks 504/506 are depicted as defining apertures 510 for receiving fasteners to install blocks 504/506. Blocks 504/506 may be positionally fixed within a device and the electrode transited therebetween, e.g., as an endless electrode loop trained about a drive pulley. Alternatively, blocks 504/506 may be attached, e.g., as a fixture, to a movable carriage (see e.g., FIGS. 11 and 12A; see also, FIG. 2A) for transiting cleaning blocks 504/506 relative to the electrode.

With reference to FIG. 7B, cleaning blocks 504/506 are shown in contact along edge portions thereof. In some implementations, cleaning blocks 504/506 may be in contact on one or both sides of the electrode during cleaning/conditioning operations. Alternatively, contact between the cleaning blocks may be used to indicate an end of life state for worn cleaning blocks in some implementations.

With reference to FIG. 7B, one or both cleaning blocks may be allowed to partially rotate about an attachment fastener inserted through fastener passage 510 such that friction or pressure from an electrode can cause a degree of rotational movement of the corresponding cleaning block. For example, a pivot point can be positioned on a cleaning block to create a first cleaning profile of electrode guide 508 in a first direction of travel and second conditioning profile of electrode guide 508 in a second direction of travel. Thus, cleaning blocks 504/506 may be moveable or otherwise variable between discrete cleaning and conditioning positions. Alternatively, cleaning blocks 504/506 can be fixed and provide for simultaneous cleaning and conditioning operations in single or multiple passes.

Figure 8:
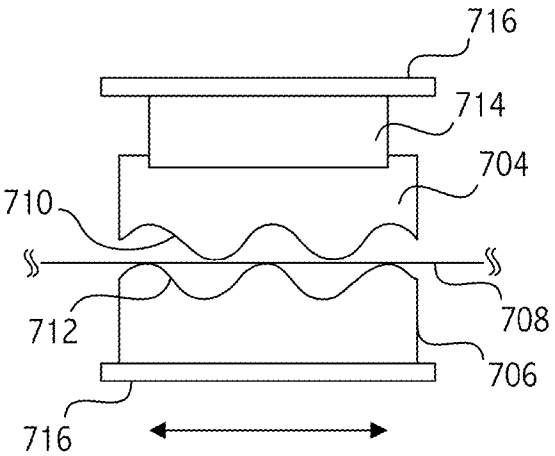

With reference to FIG. 8, cleaning blocks 704/706 define complementary opposed surfaces 710 and 712. Surfaces 710 and 712 can include ridges and grooves or channels transverse to a longitudinal orientation of electrode 708 (i.e. into the page). In some implementations, such channels can serve as reservoirs or conduits for conditioning materials to be applied to electrode 708. For example, a substantially solid wearable conditioning material may be disposed in channels or other recesses formed in one or both of surfaces 710 and 712.

Alternatively, a substantially liquid or flowable conditioning material may be dispensed to channels formed in one or both of surfaces 710 and 712 during conditioning operations. In some cases, heat can be used to render a conditioning material flowable or to alter the composition of the conditioning material before or after application to electrode 708.

In some implementations, a cleaning block can bear different materials for coating the electrode. In some implementations, the cleaning blocks define multiple channels for conveying materials to be applied to the electrode. For example, a first cleaning block channel or area can include a binder and a second channel or area can include graphite. In some cases, a binder and/or carbon bearing liquid may be injected into adjacent channels to thereby be sequentially deposited on an electrode passing by a portion of the channel as the cleaning block travels along the electrode or as the electrode is transited past the cleaning block. Accordingly, in some cases, a conditioning material may be replenished without the need to replace a cleaning block or a conditioning portion of the cleaning block.

In some cases, the binder and/or graphite may be in the form of inserts or pads disposed on the cleaning block. In some cases, the binder and/or graphite may be in the form of coatings applied to different areas of the cleaning block. In a particular case, the binder is oxidized leaving a residual conditioning material, e.g., a paraffin binder leaves a graphite residue or a solvent evaporates to leave a silver or manganese residue. In some cases, different coating materials may be positioned on a cleaning block to be sequentially applied to the electrode during single or multiple cleaning block cleaning movements.

Pressure can be provided between blocks 704/706 by a foam block 714 or spring disposed between at least one of the cleaning blocks 704/706 and a corresponding support structure, e.g., carriage arm 716. Cleaning blocks 704/706 and foam block 714 are arranged to provide pressure between cleaning blocks sufficient to frictionally clean electrode 708, which can also be deflected thereby for cleaning or conditioning.

Figure 9:
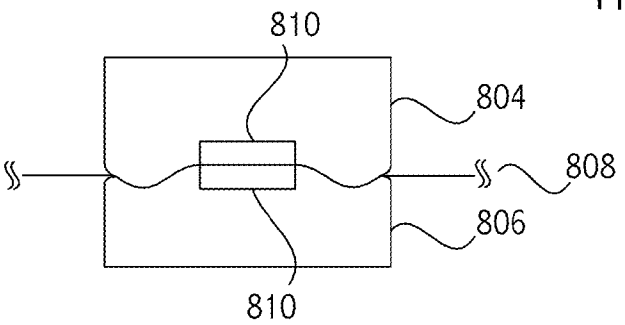
FIGS. 8, 9 and 10 depict cleaning/conditioning block variations in accordance with some embodiments of the present invention.

With reference to FIG. 9, cleaning blocks 804/806 include a conditioning material insert 810 for conditioning an electrode 808. Conditioning material inserts 804/806 are centrally positioned on cleaning blocks 804/806, such that cleaning is performed primarily at the corresponding leading edge of cleaning blocks 804/806 and conditioning is performed as the electrode 808 passes over conditioning material inserts 810.

Conditioning material inserts 810 may be removable and replaceable as needed, or may be integral with and replaceable with cleaning blocks 804/806 as needed. Conditioning material inserts 810 can include similar or different conditioning material compositions. For example, one conditioning material composition can provide an electrode shielding composition to protect against oxidation, and another conditioning material composition can include an ozone reducer. In some implementations, conditioning material compositions include a low adhesion or silicon-phobic material. In some implementations, conditioning material compositions include an organic material. In some cases, the organic material is carbon. In some cases, a conditioning material forms a sacrificial layer that inhibits dendrite formation or adhesion of detrimental materials.

Figure 10:
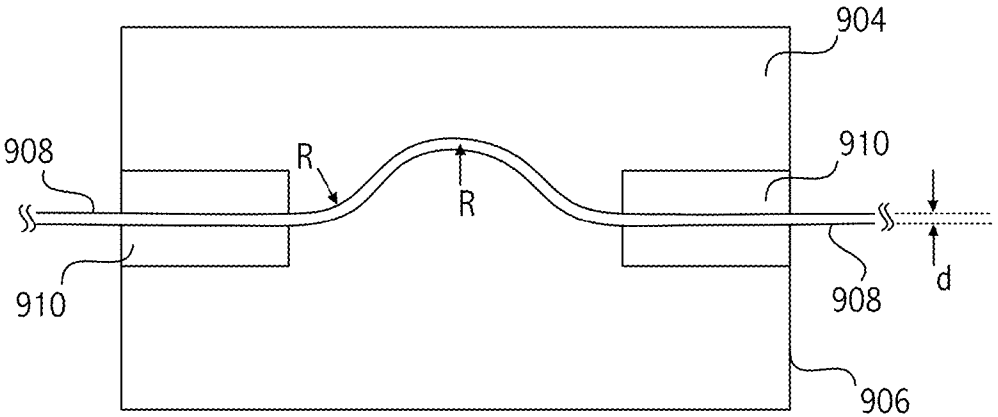

With reference to FIG. 10, conditioning material inserts 910 are positioned at outward leading and trailing edges of cleaning blocks 904/906 for conditioning electrode 908. This arrangement of conditioning material inserts 910 can be advantageous, for example, in providing a lubricating graphite conditioning material prior to deflection and frictional cleaning of electrode 908 along a central portion of cleaning blocks 904/906.

In some implementations, the cleaning blocks can include multiple cleaning or conditioning regions or surfaces. In some cases, the cleaning blocks each include at least a first region for removing dendrites from the electrode through scraping or frictional cleaning, and at least a second region for depositing a conditioning material coating on the electrode. In some cases, the cleaning and conditioning are simultaneously performed by movement of the cleaning device. The cleaning blocks may include any combination of surface profiles, including flat, curved, grooved, undulating, and the like to provide a desired degree of frictional contact and/or electrode deflection during cleaning.

Similarly, the electrode may be formed as a block, strip, or other form and the cleaning block can be constructed to contact any desired portion of the electrode. In some cases, the cleaning block may generally conform to the electrode to provide detrimental material removal across all or a major portion of the electrode. For example, the cleaning block can be constructed as a ring or cylinder enclosing an elongated electrode wire. Alternatively, the cleaning block may be positioned to clean adjacent or overlapping regions of the electrode with sequential cleaning passes. In some cases, the electrode is cleaned periodically with a single pass of the cleaning blocks. In some cases, the electrode is cleaned periodically with an initial pass and a return pass in a given conditioning cycle.

Although not specifically shown in the drawings, it will be appreciated by persons of ordinary skill in the art having benefit of the present description that granular abrasives, including granular abrasives with silver as a conditioning material constituent, may be provided. Commonly-owned co-pending U.S. application Ser. No. 12/819,966, filed Jun. 21, 2010, entitled "GRANULAR ABRASIVE CLEANING OF AN EMITTER WIRE" and naming Gao, Jewell-Larsen and Tseng as inventors illustrates, describes and further details suitable materials and structures for such granular abrasives. Application Ser. No. 12/819,966 is incorporated herein by reference for the limited purpose of its further description of materials and structures for such granular abrasives, which may optionally be employed in embodiments in accordance with the present invention(s).

Illustrative Cleaning and/or Conditioning Carriage Designs

Figure 11:
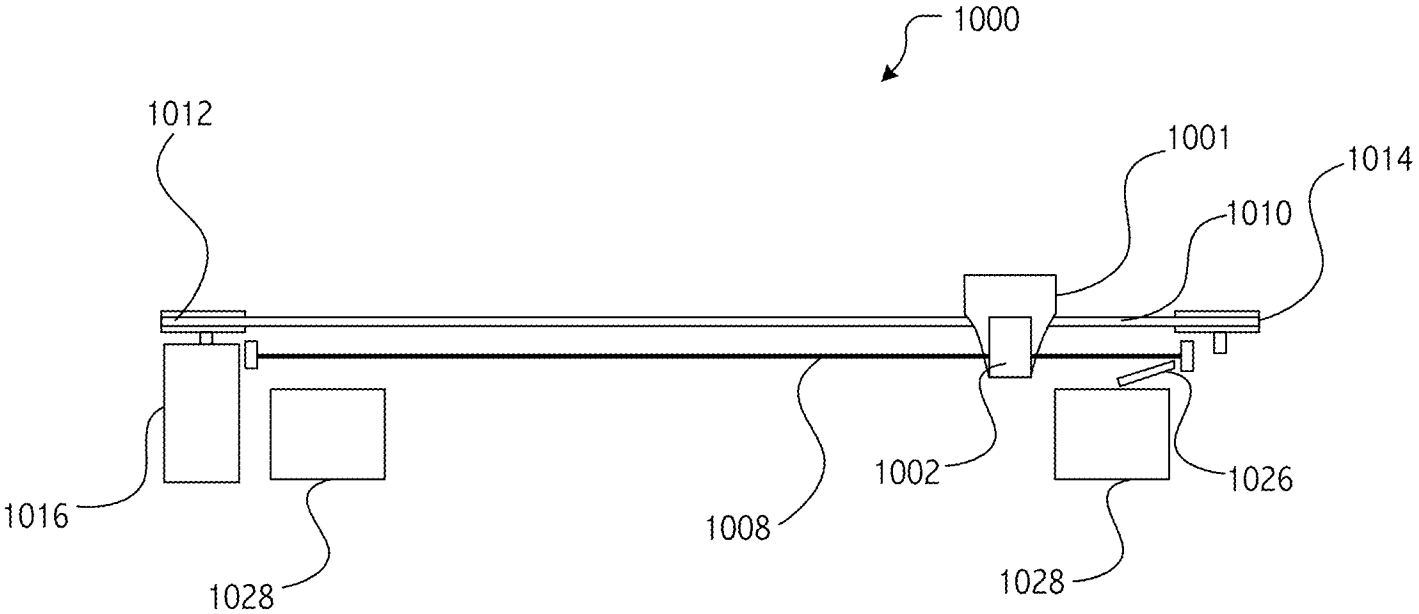
FIG. 11 depicts a carriage for transiting cleaning blocks along an electrode in accordance with some embodiments of the present invention.

With reference to FIG. 11, an EFA or EHD device 1000 includes a carriage 1001 for transiting cleaning blocks 1002 along an electrode wire 1008. Carriage 1001 can be driven or translated via a drive cable 1010 trained about a drive pulley 1012 and idler pulley 1014, with drive pulley 1012 being rotatable by a drive motor 1016. Other types of drive mechanisms may be used to move carriage 1001 to thereby clean and/or condition an electrode. Carriage 1001 may be movable for single pass cleaning/conditioning such that carriage 1001 moves between alternate ends of electrode wire 1008 in each cycle. Alternatively, carriage 1001 may be movable to perform bidirectional cleaning including moving along the return path in a single cycle. Accordingly, any number of cleaning block movements may be employed to remove dendrites or other detrimental material from electrode wire 1008 or to otherwise condition electrode wire 1008. Similarly, carriage 1001 may be driven at a desired speed to effect cleaning and conditioning of electrode wire 1008.

In a particular case, an electrode wire is placed in tension, e.g., 20 g, and is cleaned using grooved carbon cleaning blocks (like those shown in FIG. 4), with an 80 g preload between the cleaning blocks. The carriage carrying the cleaning blocks is transited along the electrode wire at about 13 mm/s in both an initial pass and a return pass. In various implementations, varying degrees of electrode tension and cleaning block speeds may be employed. For example, cleaning blocks having a softer wiper surface, e.g., felt, may employ a higher block preload, e.g., 350 g. Dendrites can form on the electrode wire in a relatively short period of operation, 30-120 minutes, potentially affecting the performance of the electrode. Accordingly, cleaning may be advantageously initiated as a function of time, detection of dendrite growth, or in response to various events, e.g., power cycles or arcing.

Carriage 1001 can carry multiple cleaning block pairs positioned to clean multiple electrodes. Device 1000 can further include grounding electrodes, repelling electrodes, backflow electrodes or other electrodes arranged to motivate air through the device to exhaust heat delivered, e.g., from a heat sink via a heat pipe. Carriage 1001 may be fitted with additional cleaning mechanisms to be transited past any number of electrodes, filters, or other system features prone to accumulation of detrimental material or in need of mechanical conditioning.

With continued reference to FIG. 11, dendrite material or other detrimental material may accumulate on the cleaning block surfaces or adjacent carriage surfaces during cleaning and conditioning of electrode 1008. A brush 1026 or other secondary cleaning device is positioned near an end of the travel path of carriage 1001 to remove accumulated detrimental material from carriage 1001. Brush 1026 is positioned to contact the cleaning blocks and/or carriage leading surfaces.

In this particular implementation, brush 1026 is positioned along an end portion of the path of travel of carriage 1001 such that advancement of carriage 1001 against brush 1026 causes brush 1026 to deflect and to thereby wipe across the affected area of the blocks and/or carriage 1001. In some implementations, other mechanisms may be used to dislodge detrimental material that accumulates on the cleaning device surfaces or carriage surfaces during electrode cleaning or conditioning operations. Brush 1026 may be positioned outside of an airflow path.

The detrimental material dislodged by brush 1026 can be accumulated in a receptacle area 1028, which can be positioned adjacent where the carriage is stowed between cleaning cycles. Passages (not shown) in the receptacle area 1028 can be provided to allow escape of the dislodged detrimental material from the system, for example, upon tipping of the system during transport. In some cases, the receptacle area 1028 may include a removable bin. Still in some implementations, passages are provided below the electrode wire such that dislodged detrimental material simply falls out of the electronic device, e.g., as a fine powder through vents in a lower surface.

Figure 12A:
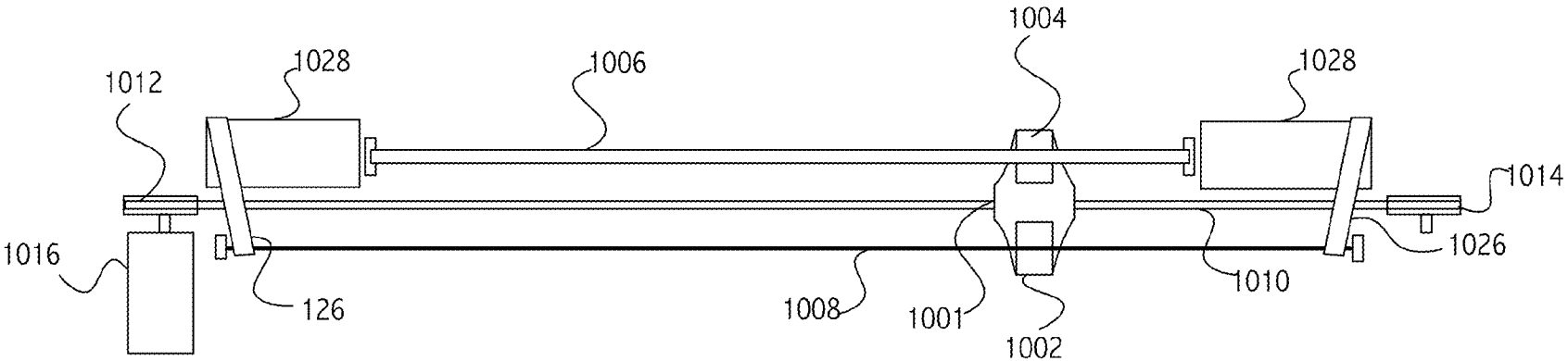
FIG. 12A depicts a carriage for transiting cleaning blocks in tandem over emitter and collector electrodes in accordance with some embodiments of the present invention.
Figure 12B:
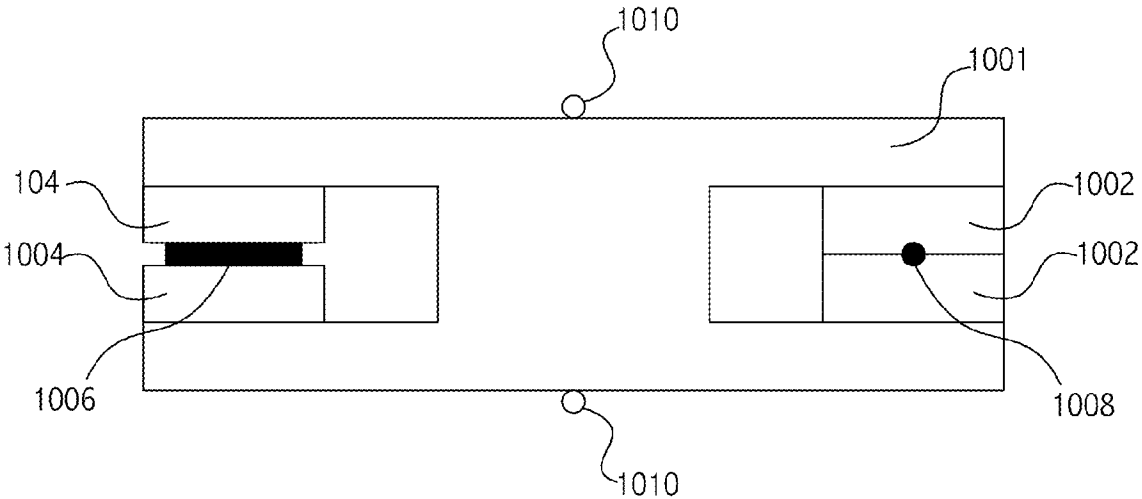
FIG. 12B illustrates a cross-section of the carriage depicted in FIG. 12A including respective cleaning/conditioning surfaces in frictional engagement with the emitter and collector electrodes.
Figure 13:
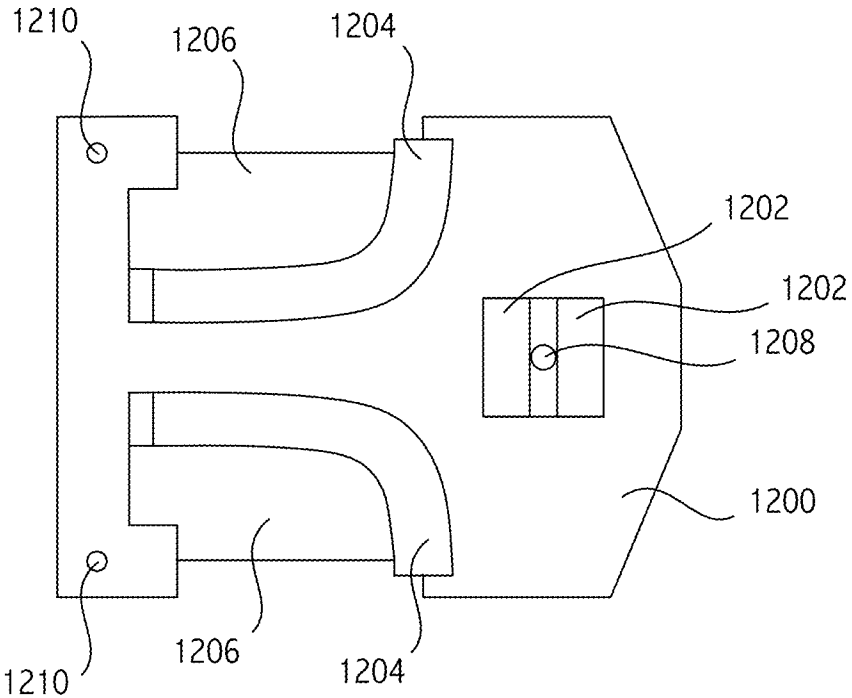
FIG. 13 depicts an alternative carriage design for transiting cleaning blocks in tandem over emitter and collector electrode surfaces in accordance with some embodiments of the present invention.

While the foregoing description emphasizes structures (carriage and transit/drive mechanisms) and techniques for cleaning and/or conditioning an elongate electrode (e.g., a wire-type emitter wire such as illustrated in FIGS. 2A and 2B as emitter electrode 91), it will also be appreciated that it may be desirable to provide tandem cleaning and/or conditioning in some implementations or designs. FIGS. 12A, 12B and 13 illustrate certain illustrative tandem travel embodiments. As with the embodiments previously described, cleaning surfaces may be formed of a wearable material and include a conditioning material composed to reduce adhesion, reduce ozone, or mitigate adverse affects of an ion bombardment or plasma environment, such as oxidation. For example, silver oxide may serve both to as a sacrificial coating and to reduce ozone.

Commonly owned, co-pending U.S. application Ser. No. 12/820,009, filed Jun. 21, 2010, entitled "CLEANING MECHANISM WITH TANDEM MOVEMENT OVER EMITTER AND COLLECTOR SURFACES" and naming Jewell-Larsen, Honer and Schwiebert as inventors, which is incorporated by reference herein, includes additional description relative to such tandem embodiments. Nonetheless to summarize regarding conditioning materials, cleaning blocks may be formed of a substantially sold, wearable graphite conditioning material. In some implementations, the wearable conditioning material is substantially softer than the electrode plating to avoid plating damage during cleaning/ conditioning. In some cases, conditioning material compositions can include carbon, silver, platinum, magnesium, manganese, palladium, nickel, or oxides or alloys of the same. In some cases, the condition material composition includes carbon, organometallic materials that decompose under plasma conditions or ion bombardment, and combinations thereof. In some implementations, the conditioning material may be selected to have an ozone reduction function, e.g., to reduce the amount of ozone generated by the device. As an illustrative example, a material that includes silver (Ag) may be used to reduce ozone production and may also be used to prevent silica growth.

Turning to structural and operational aspects of exemplary tandem embodiments, FIGS. 12A and 12B depict a cleaning mechanism (or carriage) 1001 includes respective cleaning surfaces 1002 and 1004 positioned to frictionally engage at least a portion of a respective emitter electrode 1008 and collector electrode 1006. Cleaning mechanism 1001 is moveable to cause respective cleaning surfaces 1002 and 1004 to travel in tandem along the respective surfaces of emitter electrode 1008 and collector electrode 1006 to thereby remove detrimental material such as silica dendrites, surface contaminants, particulate or other debris from the respective electrode surfaces. Cleaning surface 1002 and 1004 can be employed to remove dendrites or other detrimental material from electrodes 1008 and 1006 or to otherwise clean or condition the electrodes.

Emitter electrode 1008 and collector electrode 1006 are positioned relative to one another and energizable to generate ions to motivate fluid flow along a fluid flow path. Thus, emitter electrode 1008 and collector electrode 1006 may at least partially define an electrohydrodynamic fluid accelerator. Any number of additional electrodes may be positioned upstream and downstream of the electrohydrodynamic fluid accelerator along the fluid flow path. Additional cleaning surfaces can be provided to frictionally engage and travel over surfaces of the additional electrodes in tandem with travel of cleaning surfaces 1002 along a longitudinal extent of emitter electrode 1008. In some implementations, a collector electrode (or an additional collector electrode) can be disposed upstream of the electrohydrodynamic fluid accelerator along the fluid flow path (or laterally adjacent thereto) and can operate as an electrostatic precipitator.

While electrodes 1008 and 1006 are generally depicted as elongated or wire-type emitter and collector electrodes, any combination of electrode types and electrode surfaces may be cleaned in tandem via cleaning surfaces 1002 and 1004 via movement of cleaning mechanism 1001.

For example, a first respective cleaning surface 1002 may travel along a longitudinal extent of emitter electrode 1008 and a second respective cleaning surface, e.g., cleaning surface 1004, travels in tandem over a major dimension of a surface of collector electrode 1006 or another electrode. For example, an ESP or EHD device can include grounding electrodes, repelling electrodes, backflow electrodes or other electrodes arranged to motivate air through the device to exhaust heat delivered, e.g., from a heat sink via a heat pipe.

In the illustrated implementation, cleaning mechanism 1001 includes multiple cleaning surface pairs 1002 and 1004 positioned to clean opposite surfaces of respective electrodes 1008 and 1006. Cleaning surfaces 1002, 1004 can be contoured to clean all or part of a respective electrode. For example, cleaning surfaces 1002 can provide substantially complete circumferential contact with emitter electrode 1008 via grooves formed in cleaning surfaces 1002. Cleaning and/or conditioning aspects of cleaning surfaces 1002 will be understood based on the description herein of like surfaces and materials (recall e.g., the foregoing description of in situ cleaning/conditioning and FIGS. 3-5, 7A, 7B and 8-10).

Referring again to FIGS. 12A and 12B, while electrodes 1008 and 1006 are generally referred to as emitter and collector electrodes respectively, cleaning mechanism 1001 may more generally be used to clean any combination of two or more electrodes. Additionally, cleaning mechanism 1001 may be fitted with additional cleaning surfaces to be transited past any number of electrodes, filters, or other system features prone to detrimental material accumulation and in need of mechanical cleaning or other surface conditioning.

Cleaning mechanism 1001 can be driven or translated via a drive cable 1010 trained about a drive pulley 1012 and idler pulley 1014, with drive pulley 1012 being rotatable by a drive motor 1016. Other types of drive mechanisms may be used to move cleaning mechanism 1001 to thereby clean and/or condition an electrode. FIGS. 2A and 2B illustrate an exemplary screw drive or worm gear type mechanism that may be employed in alternative embodiments.

Alternatively, in some implementations, electrodes may be driven in tandem past respective cleaning surfaces. Referring illustratively to features illustrated in FIGS. 12A and 12B, electrodes 1008 and/or 1006 may themselves be trained about drive pulleys, similar to drive cable 1010. Electrodes 1008 and 1006 may be in the form or elongated wires or bands and may be transited in the same or opposite directions past cleaning mechanism 1001 by respective drive pulleys or other drive mechanisms. In a particular implementation, an elongated ribbon-like electrode is twisted to form a mobius strip. A mobius strip electrode configuration can be advantageous for cleaning opposed surfaces of an electrode with a single cleaning surface. Thus, in some implementations, tandem cleaning of two electrodes may be performed by movement of the electrodes in the same or opposite direction past respective cleaning surfaces of a cleaning mechanism.

Cleaning mechanism 1001 may be movable in single passes such that cleaning mechanism 1001 moves between alternate ends of electrodes 1008 and 1006 in each cycle. Alternatively, cleaning mechanism 1001 may reciprocate or move bidirectionally in a single cycle or it in may perform any number of movements at any desired speed in a given cycle. In some implementations, cleaning operations may be repeated, extended, or tailored to achieve a desired degree of cleaning as determined by testing performance characteristics between cleaning cycles. For example, after a first cleaning cycle, an emitter electrode can be energized and various performance characteristics measured, e.g., voltage, current, sparking, and the like. Additional cleaning cycles may then be initiated as needed and additional performance checks conducted to determine sufficiency of electrode cleaning.

With continued reference to FIGS. 12A and 12B, dendrite material or other detrimental material may accumulate on the exterior of cleaning mechanism 1001, e.g. adjacent cleaning surfaces 1002 or 1004 during cleaning and conditioning of electrodes 1008 and 1006. Accordingly, in some embodiments, a secondary cleaning device, e.g., brush 1026, is positioned near an end of the travel path of cleaning mechanism 1001 to remove accumulated detrimental material from cleaning mechanism 1001. Brush 1026 is positioned to contact the cleaning mechanism exterior, e.g., leading edges or surfaces adjacent cleaning surfaces 1002 and 1004 where detrimental material dislodged from electrodes 1008 or 1006 may accumulate on cleaning mechanism 1001. Thus, secondary detrimental material accumulation may be removed from cleaning mechanism 1001 including cleaning surfaces 1002 and 1004 by brush 1026 or other suitable secondary cleaning device.

In some implementations, electrodes 1008 and/or 1006 are elongated wire electrodes that are placed in tension and the cleaning mechanism 1001 defines respective cleaning surfaces 1002 and 1004 contoured or otherwise shaped to contact a desired portion of electrodes 1008 and 1006. For example, in some cases, cleaning surfaces substantially conform to a profile or shape of a surface of a respective electrode 1008 or 1006. Thus, a grooved cleaning surface may receive an elongated electrode to travel along a longitudinal extent or surface thereof. Similarly, a substantially planar cleaning surface may be transited over a substantially planar major portion of a respective electrode. In some cases, the electrode is substantially rigid and the cleaning surface conforms to the electrode. In other cases, the electrode may conform somewhat to the cleaning surface, for example, in the case of a wire electrode and a contoured cleaning surface.

In some implementations, the respective opposed cleaning surfaces are urged against one another or against the respective electrode by an applied force. In a particular case, elongated electrode wires are positioned in spaced relation, e.g., 1-5 mm and energizable to establish a corona discharge therebetween. The electrodes are placed in tension, e.g., 10-30 g, and are cleaned using grooved carbon cleaning surfaces, with a 40-80 g preload between the cleaning surfaces and the respective electrode. The carbon bearing cleaning surfaces are transited in tandem along the respective electrodes at about 13 mm/s in both an initial pass and a return pass. The carbon present on the cleaning surfaces preferably has a hardness selected to effectively remove detrimental material from the electrode while not abrading the electrode material or electrode surface coating. In some cases, the carbon is sufficiently soft to wear and deposit a carbon coating on the electrode. Carbon is but one example of a conditioning material that may be present on cleaning surfaces 1002 and 1004. Other conditioning materials may be used, e.g., to provide ozone reducing coatings, sacrificial coatings, electrode surface refinishing, electrode lubrication, or other useful conditioning of electrodes. In some cases, the conditioning material includes silver.

Sufficient dendrites can form on the electrode wire to potentially affect the performance of the electrode in a relatively short period of operation, 2-4 hours under extreme conditions. Accordingly, cleaning may be advantageously initiated as a function of time, detection of dendrite growth, or in response to various events, e.g., power cycles or electrode arcing.

With reference to FIG. 13, a drive cable 1210 or other suitable driving structure may be positioned to the outside of the electrodes rather than between the electrodes as in FIGS. 12A and 12B. For example, in some implementations, drive cable 1210 is positioned to the far side or outside of collector electrodes 1206 such that cleaning mechanism (or carriage) 1200 extends from drive cable 1210 between and past collector electrodes 1206 to emitter electrode 1208. Such positioning of drive belt or drive cable 1210 further from emitter electrode 1208 can reduce charging and sparking to drive cable 1210 from the electric field around emitter electrode 1208 and can also help avoid interference with the electric field around emitter electrode 1208.

In some implementations, electrodes 1206 can serve as a guide for movement and alignment of cleaning mechanism 1200. In some cases, cleaning mechanism 1200 can be slidingly retained on electrodes 1206. For example, cleaning mechanism 1200 can extend between electrodes 1206 from the rear to the front of electrodes 1206 with cleaning surfaces 1204 retained thereby adjacent respective surfaces of electrodes 1206. Cleaning surfaces 1202 are shown positioned on either side of emitter electrode 1208 in a vertical orientation.

Figure 14A:
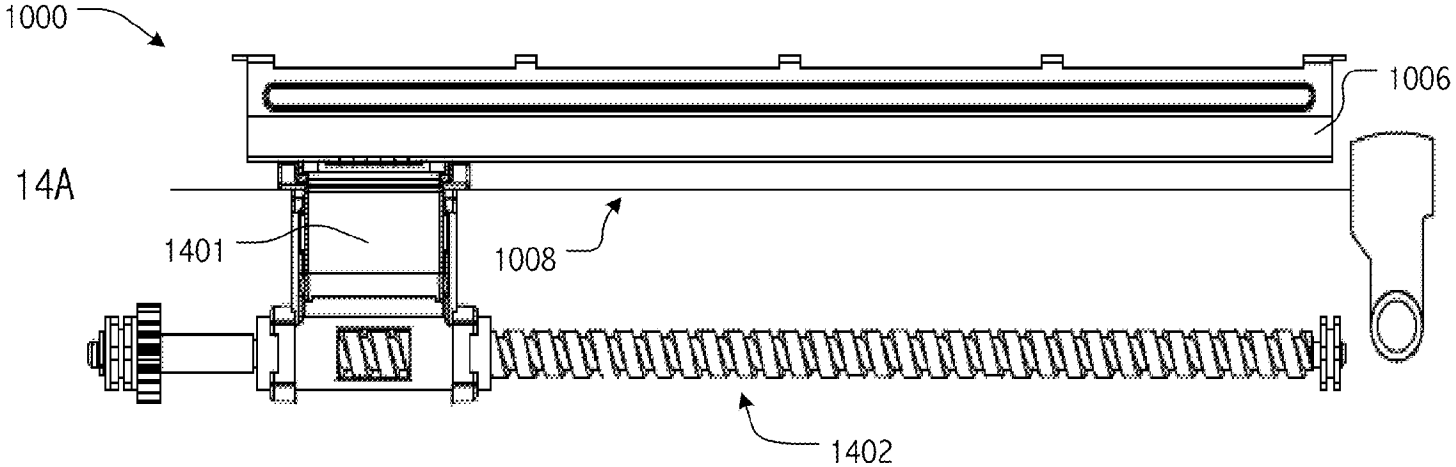
FIGS. 14A, 14B and 14C collectively illustrate a further embodiment in which tandem travel of electrode cleaning/conditioning surfaces over emitter and collector electrode surfaces of an exemplary EHD air mover subassembly is provided using a screw drive or worm gear type mechanism.
Figure 14B:
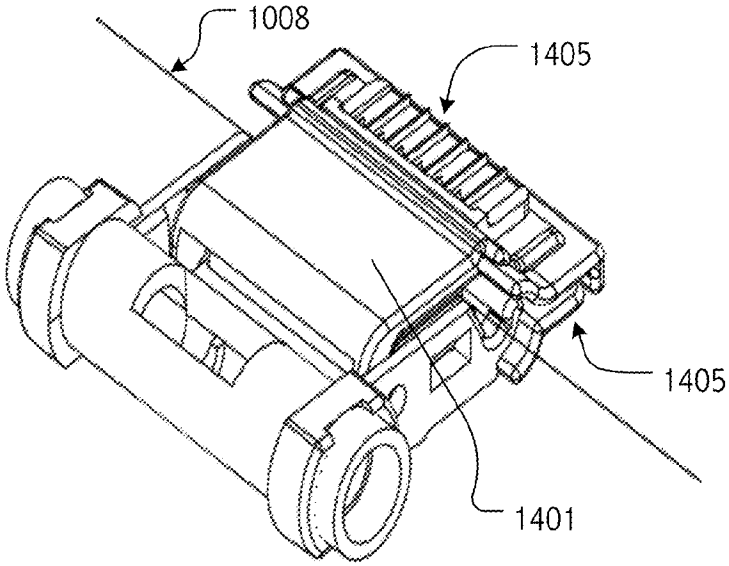
Figure 14C:
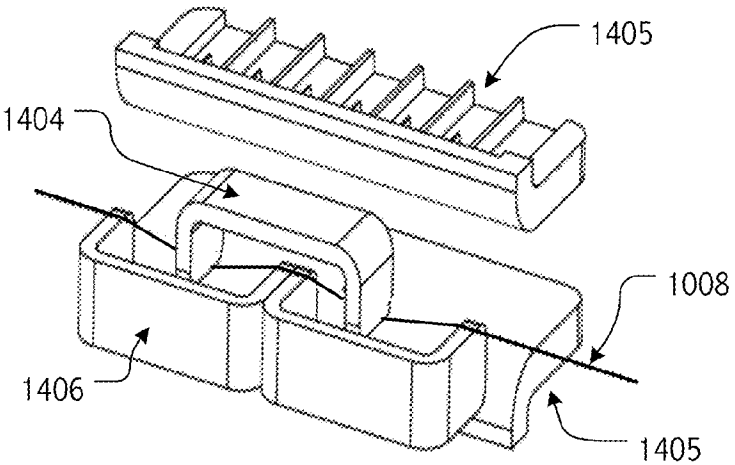

FIGS. 14A, 14B and 14C collectively illustrate a further embodiment in which tandem travel of electrode cleaning/conditioning surfaces over emitter and collector electrode surfaces of an exemplary EHD air mover subassembly is provided using a screw drive or worm gear type mechanism. FIG. 14A depicts a top view of an EHD air mover 1000 which includes a wire-type emitter electrode 1008 and a pair of collector electrode 1006 (one instance of which is visible in top view) energizable to establish air flow. A conditioning mechanism (principally carriage 1401 and related drive mechanisms and frictionally engaged surfaces) transits cleaning/conditioning surfaces over electrodes 1008 and 1006 motivated by a drive mechanism (e.g., an electric motor and reduction gears omitted for clarity) that rotates screw drive or worm gear 1402 within the threaded body of carriage 1401.

FIG. 14B, in turn, provides an exterior perspective view of carriage 1401 at increased scale and depicts passage emitter electrode 1008 through carriage 1401 (and in frictional engagement with interior cleaning/conditioning surfaces that are not visible in the exterior perspective view). Collector electrodes are omitted in the FIG. 14B view; however, corresponding cleaning/conditioning surfaces 1405 for conformal frictional engagement with surfaces of collector electrodes 1006 are shown. Finally, FIG. 14C provides an interior view (with external and major structural components removed) of respective cleaning/conditioning surfaces, including opposing wearable edges surfaces of "U" or "C" shaped blocks 1404 and 1406 in frictional engagement with emitter electrode 1008.

With continued reference to FIGS. 14B and 14C, in some embodiments, conditioning mechanisms may include grooved cleaning pads 1405 positioned to frictionally engage respective surfaces of collector electrodes 1006. In the illustrated embodiment, cleaning pads 1405 define a series of alternating grooves and ridges. The ridges serve to provide individual leading abrasive edges while the grooves serve to receive and convey dislodged debris towards an outer edge thereof.

With particular reference to FIG. 14C, conditioning mechanisms provided within carriage 1401 include conditioning structures 1404 and 1406 that define a series of projections. The projections impinge upon wire-type emitter electrode 1008 to induce undulation or other elastic deformation of the emitter electrode. Conditioning structures 1404 and 1406 can be formed of a wearable material to deposit a conditioning material on the surface of emitter electrode 1008. In some cases, the conditioning material includes silver, which can serve mitigate ozone generated by operation of the EHD device in the corona established proximate the surface of emitter electrode 1008. In some cases, the conditioning material can include carbon, which can serve to mitigate formation of silica dendrites.

The projections can be in the form of wearable blades that are spaced apart and offset from one or more opposed blades to produce a desired deformation of emitter electrode 1008. The blades further serve to wipe undesirable material from the emitter electrode 1008 and to deposit the conditioning material(s), typically including silver. In some implementations such as that illustrated, the blades are formed as legs of a generally C-shaped or U-shaped conditioning structure. With reference to FIG. 14C, upper structure 1404 is positioned opposite lower structures 1406 to provide spaced apart projections to impinge upon emitter electrode 1008. Conditioning structures 1404 and 1406 are depicted as generally U-shaped, similar in form to a thick staple. However, more generally, conditioning structures 1404 and 1406 may be formed in any number of geometries to position projections to act upon emitter electrode 1008 and, when transited thereover, to deposit conditioning material such as silver thereon.

With reference to FIG. 14C, conditioning structures 1404 and 1406 are positioned with a controlled offset by an at least partially floating support that can be biased with controlled offset to provide desired friction with, and deformation of, emitter electrode 1008 as well as to accommodate wear. In general, biasing can be provided by a spring, foam block or other suitable biasing structure.

Figure 15C:
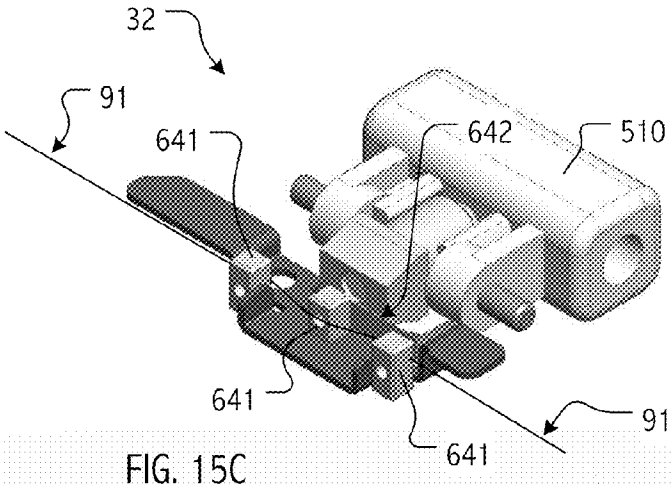
FIGS. 15A, 15B and 15C collectively illustrate another embodiment in which tandem travel of electrode cleaning/conditioning surfaces over emitter and collector electrode surfaces of an exemplary EHD air mover subassembly is provided using a screw drive or worm gear type mechanism.
Figure 15B:
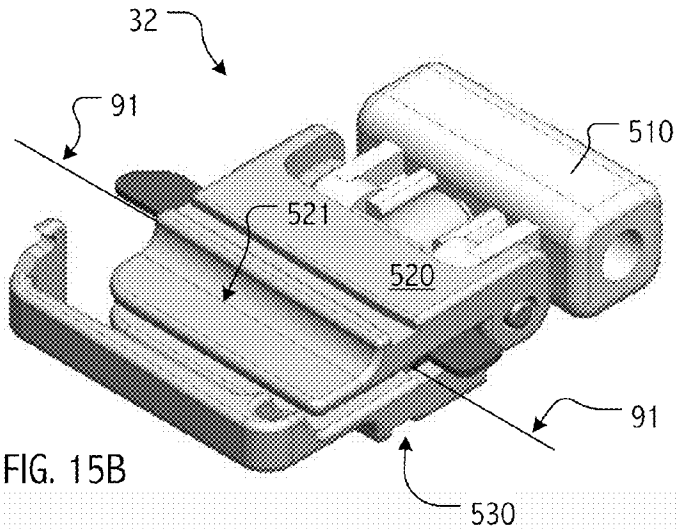
Figure 15A:
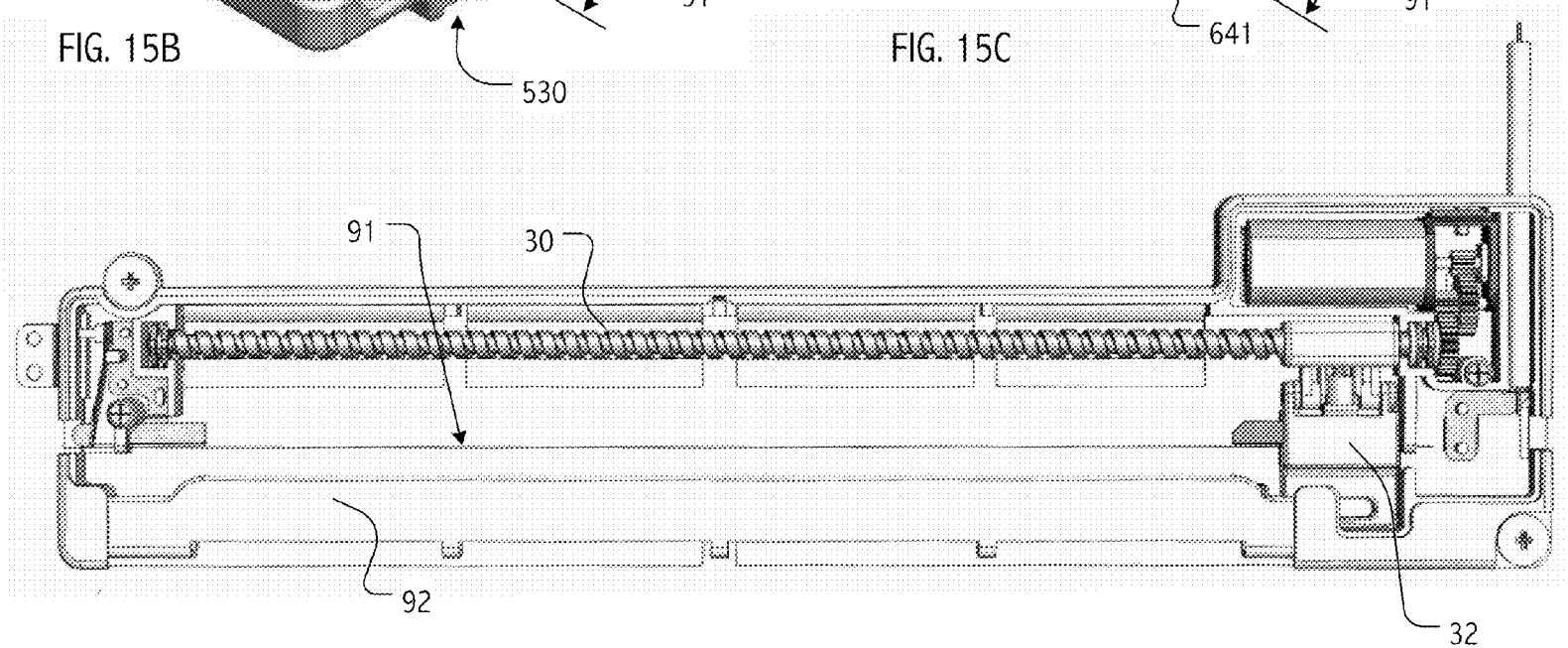

FIGS. 15A, 15B and 15C collectively illustrate another embodiment in which tandem travel of electrode cleaning/conditioning surfaces over emitter and collector electrode surfaces of an exemplary EHD air mover subassembly is provided using a screw drive or worm gear type mechanism. Emitter and collector electrodes (91 and 92) as well as operation of screw or worm gear 30 driven carriage 32 will be understood based on the foregoing description, particularly that of FIGS. 2A and 2B. More specifically, FIG. 15B illustrates an exploded detail perspective view of an illustrative embodiment of carriage 32 in which upper and lower body portions (520 and 530, respectively) are contoured to support frictional engagement with surfaces of collector electrodes 92 (for cleaning/conditioning thereof) and emitter electrode conditioning surfaces are provide in the interior of carriage 32. FIG. 15C provides a corresponding exploded detail perspective view of interior of cleaning/conditioning surfaces 641 frictionally engaged with emitter electrode 91 to deposit conditioning material including silver or the surface thereof. In the illustrated embodiment, cleaning/conditioning surfaces 641 are formed as metallic silver projections or posts positioned and biased (using a spring 642) to elastically deform emitter electrode 91.

Figure 16A:
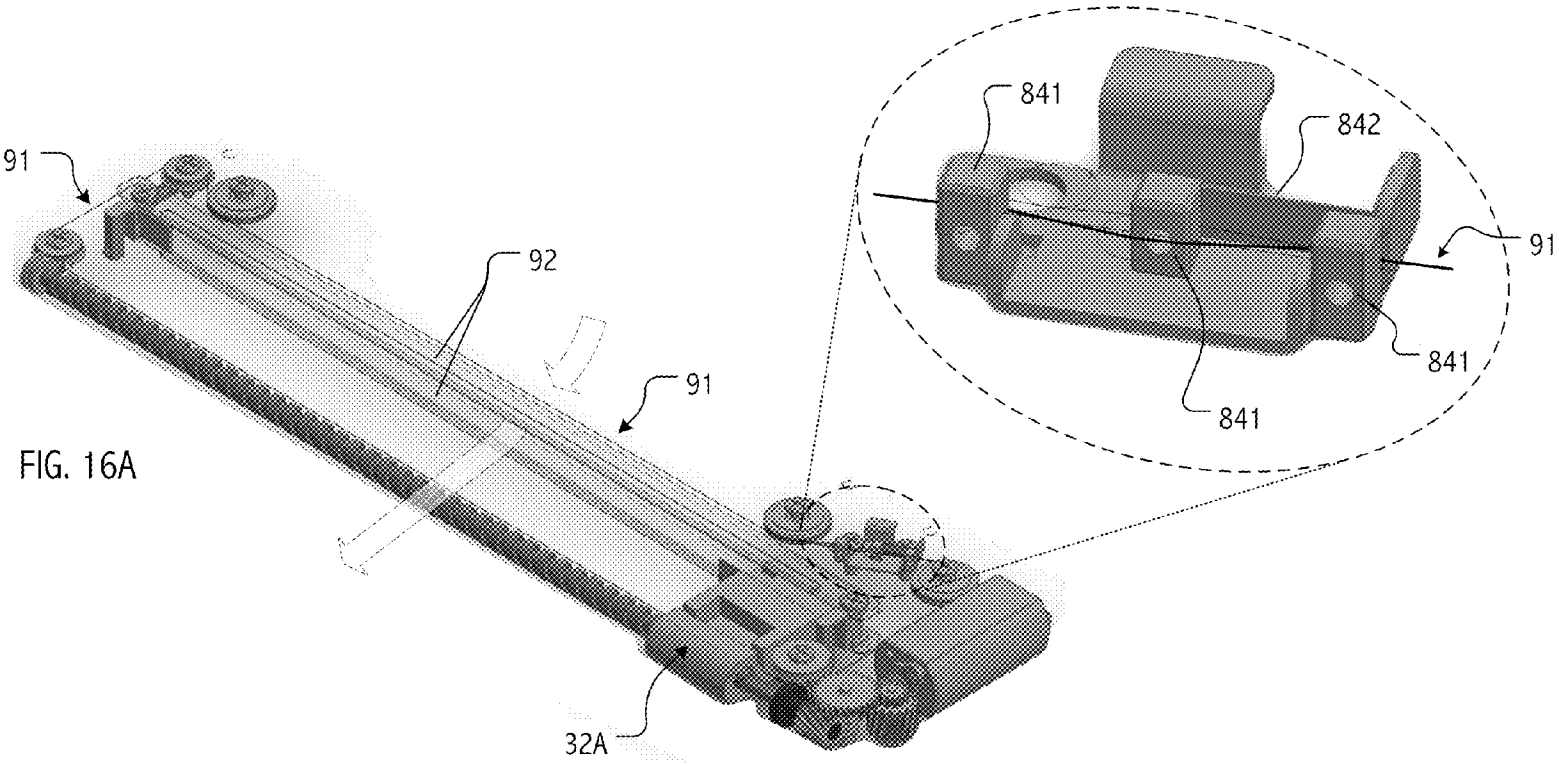
FIGS. 16A and 16B collectively illustrate still another embodiment in which it is the emitter electrode of an exemplary EHD air mover subassembly (configured as a continuous loop of emitter wire) that travels over electrode cleaning/conditioning surfaces.
Figure 16B:
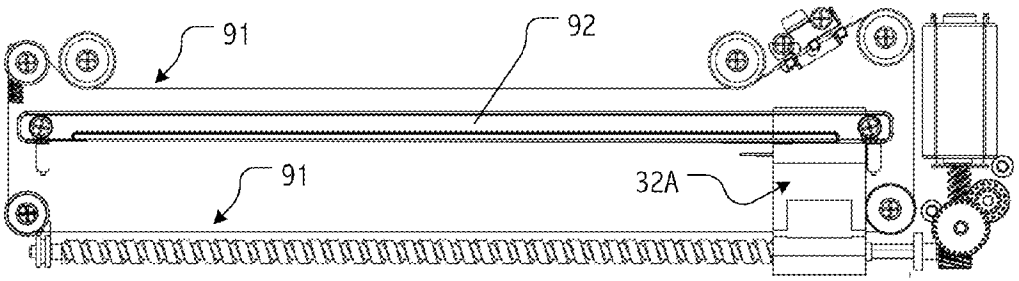

FIGS. 16A and 16B collectively illustrate still another embodiment in which it is the emitter electrode of an exemplary EHD air mover subassembly (configured as a continuous loop of emitter wire) that travels over electrode cleaning/conditioning surfaces. As before, emitter and collector electrodes (91 and 92) will be understood based on the foregoing descriptions, although it is worth noting that, in the embodiment of FIGS. 16A and 16B emitter electrode 91 is provided as a continuous loop of emitter wire and is itself advanced (by frictional engagement with screw or worm gear driven carriage 32A) past a fixed emplacement of cleaning/conditioning surfaces 841 analogous to the carriage-positioned surfaces and mechanism described above.

Illustrative System and Electronic Device Embodiments

Figure 17:
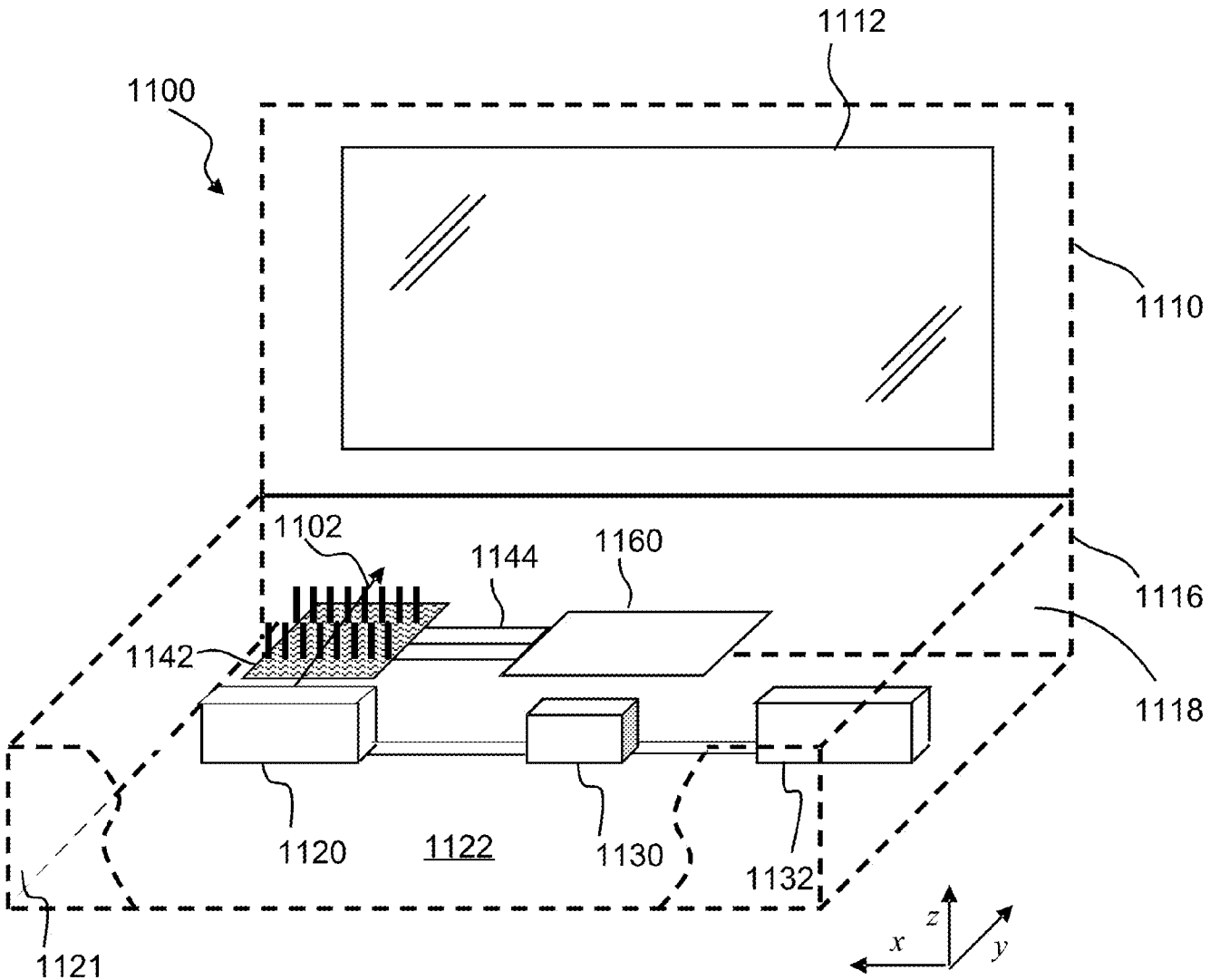
FIG. 17 depicts an electronic system in which an EHD device and mechanisms for transiting electrode conditioning and/or cleaning surfaces over emitter and/or collector electrode surfaces thereof are provided in accordance with some embodiments of the present invention.

FIG. 17 is a schematic block diagram illustrating one implementation of an environment in which cleaning mechanism may operate. An electronic device 1100 such as a computer includes an EFA or EHD air cooling system 1120. Electronic device 1100 comprises a substantially rectangular housing 1116, or case, having a cover 1110 that includes a display device 1112. A portion of the front surface 1121 of housing 1116 has been cut away to reveal interior 1122. Housing 1116 of electronic device 1100 may also comprise a top surface (not shown) that supports one or more input devices that may include, for example, a keyboard, touchpad and tracking device. Electronic device 1100 further comprises electronic circuit 1160 which generates heat in operation. A thermal management solution comprises a heat pipe 1144 that draws heat from electronic circuit 1160 to heat sink device 1142.

Device 1120 is powered by high voltage power supply 1130 and is positioned proximate to heat sink 1142. Electronic device 1100 may also comprise many other circuits, depending on its intended use; to simplify illustration of this second implementation, other components that may occupy interior area 1122 of housing 1120 have been omitted from FIG. 17.

With continued reference to FIG. 17, in operation, high voltage power supply 1130 is operated to create a voltage difference between emitter electrodes and collector electrodes disposed in device 1120, generating an ion flow or stream that moves ambient air toward the collector electrodes. The moving air leaves device 1120 in the direction of arrow 1102, traveling through the protrusions of heat sink 1142 and through an exhaust grill or opening (not shown) in the rear surface 1118 of housing 1116, thereby dissipating heat accumulating in the air above and around heat sink 1142. Note that the position of illustrated components, e.g., of power supply 1130 relative to device 1120 and electronic circuit 1160, may vary from that shown in FIG. 17.

A controller 1132 is connected to device 1120 and may use sensor inputs to determine the state of the air cooling system, e.g., to determine a need for cleaning electrodes. Alternatively, the cleaning may be initiated by controller 1132 on a timed or scheduled basis, on a system efficiency measurement basis or by other suitable methods of determining when to clean electrodes. For example, detection of electrode arcing or other electrode performance characteristics may be used to initiate movement of the cleaning mechanism to condition the electrode.

In some implementations, the cleaning or other conditioning is performed when the electrode is not in use. Alternatively, cleaning operations may be performed at timed intervals. In some cases, conditioning or cleaning may be initiated by controller 1132 based upon one or more of an imposed voltage level, a measured electrical potential, determination of the presence of a level of contamination by optical means, be detection of an event or performance parameter, or other methods indicating a benefit from mechanically cleaning the electrode.

Thus, the electrode(s) to be cleaned or conditioned can constitute at least a portion of a thermal management assembly thermally coupled to a heat dissipating device in an electronic device. At least one of the electrode and the cleaning device is moveable in response to detection of one of a low thermal duty cycle, power on cycle and a power off cycle of the electronic device. For example, a low CPU usage cycle may be an appropriate time to de-energize an electrode for cleaning/conditioning.

While the foregoing is illustrative of a particular computer-type electronic device, it will be appreciated that EHD devices, including EHD air mover devices such as described herein with cleaning and/or conditioning mechanisms for in situ conditioning of emitter electrode surfaces with a conditioning material that includes silver (Ag), have broad applicability to varied devices such as a laptop, notebook, netbook, pad or tablet-type computing device, a projector, a copy machine, a fax machine, a printer, a radio, an audio or video recording device, an audio or video playback device, a communications device, a charging device, a power inverter, a light source, a medical device, a home appliance, a power tool, a toy, a game console, a set-top console, a television, a video display device, etc. Nothing in FIG. 17 or the description thereof shall be taken as limiting the application of materials, structures and techniques described herein.

Some implementations of thermal management systems described herein employ EFA or EHD devices to motivate flow of a fluid, typically air, based on acceleration of ions generated as a result of corona discharge. Other implementations may employ other ion generation techniques and will nonetheless be understood in the descriptive context provided herein. Using heat transfer surfaces that may or may not be monolithic or integrated with collector electrodes, heat dissipated by electronics (e.g., microprocessors, graphics units, etc.) and/or other components can be transferred to the fluid flow and exhausted. Typically, when a thermal management system is integrated into an operational environment heat transfer paths (often implemented as heat pipes or using other technologies) are provided to transfer heat from where it is dissipated (or generated) to a location (or locations) within the enclosure where air flow motivated by an EFA or EHD device (or devices) flows over heat transfer surfaces.

In some implementations, an EFA or EHD air cooling system or other ion motive or flow generating device employing an electrode cleaning system may be integrated in an operational system such as a laptop or desktop computer, a projector or video display device, etc., other implementations may take the form of subassemblies. Various features may be used with different ion motive or flow generating devices including EFA and EHD devices such as air movers, film separators, film treatment devices, air particulate cleaners, photocopy machines and cooling systems for electronic devices such as computers, laptops and handheld devices.

While the forgoing represents a description of various implementations or implementations of the invention, it is to be understood that the claims below recite the features of the present invention, and that other implementations, not specifically described hereinabove, fall within the scope of the present invention.

Additional Embodiments

Some implementations of thermal management systems described herein employ EFA or EHD devices to motivate flow of a fluid, typically air, based on acceleration of ions generated as a result of corona discharge. Other implementations may employ other ion generation techniques and will nonetheless be understood in the descriptive context provided herein. Using heat transfer surfaces, heat dissipated by electronics (e.g., microprocessors, graphics units, etc.) and/or other electronic system components can be transferred to the fluid flow and exhausted. Heat transfer paths, e.g., heat pipes, are provided to transfer heat from a heat source within the internal plenum to a location(s) within the enclosure where air flow motivated by an EHD device(s) flows over heat transfer surfaces to dissipate the heat.

In some implementations, enclosure and/or duct surfaces along the flow path can be provided with an ozone reducing material. In some applications, an ozone catalytic or reactive material can be provided on surfaces exposed to the internal air plenum. Similarly, ozone resistive or tolerant coatings can be provided on surfaces exposed to the internal air plenum. Ozone reducing materials can include ozone catalysts, ozone binders, ozone reactants or other materials suitable to react with, bind to, or otherwise reduce or sequester ozone. In some implementations, the ozone reducing material is a catalyst selected from a group that includes: manganese (Mn); manganese dioxide ($MnO_2$); gold (Au); silver (Ag); silver oxide ($Ag_2O$); and an oxide of nickel (Ni); and an oxide of manganese preparation. Ozone reducing material can be applied to internal enclosure surfaces and/or to the surface of electronic components within an enclosure. Ozone reducing material can additionally be applied to electronic system components. Similarly, surfaces of any number of the electronic components within an enclosure, and even internal enclosure surfaces can be provided with ozone tolerant, or ozone resistant coating to mitigate the effects of ozone.

In some implementations, an EFA or EHD air cooling system or other similar ion action device may be integrated into an operational system such as a laptop, tablet or desktop computer, a projector or video display device, etc., while other implementations may take the form of subassemblies. previously incorporated U.S. patent application Ser. No. 13/105,343, filed May 11, 2011, illustrates relative to certain thin (high-aspect ratio) laptop/notebook computer, tablet or pad-type computer and display device exploitations, EFA or EHD air cooling system deployments in which in situ emitter electrode conditioning techniques may be advantageously included. More generally features described herein may be used with different devices including EFA or EHD devices such as air movers, film separators, film treatment devices, air particulate cleaners, photocopy machines and cooling systems for electronic devices such as computers, laptops and handheld devices. One or more EHD cooled devices can include one of a computing device, projector, copy machine, fax machine, printer, radio, audio or video recording device, audio or video playback device, communications device, charging device, power inverter, light source, medical device, home appliance, power tool, toy, game console, set-top console, television, and video display device. Furthermore, in some cases, emitter-wire type ion source subassemblies used in devices that provide electrostatic printing or copying may be augmented to provide in situ emitter electrode conditioning such as described herein.

While the foregoing represents a description of various implementations of the invention, it is to be understood that the claims below recite the features of the present invention, and that other implementations, not specifically described hereinabove, fall within the scope of the present invention.

What is claimed is:

1. An apparatus comprising:

an electrohydrodynamic (EHD) device that includes an emitter electrode energizable to motivate ion flow; and a conditioning surface to frictionally engage the emitter electrode, wherein the conditioning surface and a frictionally engaged surface of the emitter electrode are movable relative to one another to, at successive times throughout the operating life of the apparatus, deposit a conditioning material comprising silver on the frictionally engaged surface of the emitter electrode.

2. The apparatus of claim 1, wherein the conditioning material comprising silver includes one or more of elemental silver, an oxide of silver, an alloy of silver and an organometallic silver compound.

3. The apparatus of claim 2, wherein the conditioning material comprising silver further includes a material selected to at least partially mitigate at least one of electrode erosion, corrosion, oxidation, silica adhesion and dendrite formation.

4. The apparatus of claim 2, wherein the conditioning material comprising silver further includes graphite.

5. The apparatus of claim 1, wherein the conditioning material comprising silver deposited on the emitter electrode at the successive times throughout the operating life of the apparatus constitutes a consumable ozone reducer.

6. The apparatus of claim 1, wherein the emitter electrode includes at least one elongate emitter wire.

7. The apparatus of claim 6,
wherein positioning and the relative movement of the conditioning surface and the elongate wire with respect to one another provide elastic deformation of the elongate emitter wire at a point of the frictional engagement.

8. The apparatus of claim 6,
wherein the conditioning surface includes a body of the conditioning material at least partially conformal with a surface of the elongate emitter wire.

9. The apparatus of claim 1, further comprising:
one or more additional conditioning surfaces positioned for frictional engagement with respective portions of the surface of the emitter electrode.

10. The apparatus of claim 1, further comprising:
a carriage to which the conditioning surface is affixed; and
a drive mechanism operably coupled to the carriage to cause the conditioning surface to transit at least a portion of the emitter electrode.

11. The apparatus of claim 1, further comprising:
a controller operable to trigger movement, at the successive times, of one of the conditioning surface and the emitter electrode relative to the other.

12. The apparatus of claim 1,
wherein the EHD device includes one or more collector electrodes and is energizable to motivate air flow.

13. The apparatus of claim 12, further comprising:
a heat sink,
wherein the EHD device is configured to motivate the air flow past the heat sink.

14. The apparatus of claim 12,
packaged as one of a computer, a laptop, notebook, tablet or handheld electronic device and a video display,
wherein the EHD device is configured to provide the computer, laptop, notebook, tablet or handheld electronic device or video display with ventilating air flow; and
wherein the conditioning material comprising silver deposited on the emitter electrode at the successive times throughout the operating life of the apparatus constitutes a consumable ozone reducing material.

15. The apparatus of claim 1,
wherein the EHD device includes one or more collector electrodes and is energizable to precipitate particulates from an air flow.

16. A method of managing ozone in an electrohydrodynamic (EHD) device, the method comprising:
energizing an emitter electrode of the EHD device to motivate ion flow; and
at successive times throughout the operating life of the apparatus and in situ, moving a conditioning surface and a frictionally engaged surface of the emitter electrode relative to one another to deposit a consumable conditioning material comprising silver on the frictionally engaged surface of the emitter electrode.

17. The method of claim 16,
wherein the consumable conditioning material comprising silver includes one or more of elemental silver, an oxide of silver, an alloy of silver and an organometallic silver compound.

18. The method of claim 17,
wherein the deposited consumable conditioning material comprising silver further includes a material selected to at least partially mitigate at least one of electrode erosion, corrosion, oxidation, silica adhesion and dendrite formation.

19. The method of claim 17,
wherein the deposited consumable conditioning material comprising silver further includes graphite.

20. The method of claim 16, further comprising:
at the successive times, triggering the movement based on one or more of an event and sensed or detected condition.

21. The method of claim 20,
wherein the triggering event is or corresponds to a power or thermal management event.

22. The method of claim 20,
wherein the triggering condition is or corresponds to a power or thermal management state.

23. The method of claim 20,
wherein the triggering event is an timed or scheduled event.

24. The method of claim 20,
wherein the sensed or detected condition is indicative of electrode arcing.

25. The method of claim 20,
wherein the sensed or detected condition is indicative of accumulated detrimental material on the emitter electrode.

26. The method of claim 16, further comprising:
at least during the movement, de-energizing the emitter electrode.

27. The method of claim 16, further comprising:
at least during the movement, reducing the energizing of the emitter electrode to a reduced power level or state.

28. The method of claim 16, further comprising:
at the successive times throughout the operating life of the apparatus, causing a carriage to which the conditioning surface is affixed to transit at least a portion of the emitter electrode.

29. The method of claim 28, further comprising:
at the successive times throughout the operating life of the apparatus, transiting a cleaning surface affixed to the carriage and in frictional engagement with a collector electrode of the EHD device along a portion of the collector electrode to remove at least some detrimental material therefrom.

30. The method of claim 16,
wherein the emitter electrode includes at least one elongate emitter wire; and
further comprising, in correspondence with the relative movement of the conditioning surface and the emitter electrode with respect to one another, elastically deforming the elongate emitter wire at a point of the frictional engagement.

31. The method of claim 16, further comprising:
motivating air flow using the EHD device.

32. The method of claim 16,
precipitating particulates from an air flow using the EHD device.

33. A method of making an electronic device product capable of renewing in situ a consumable ozone reducing material to at least partially abate ozone otherwise produced during operation of the electronic device product, the method comprising:
tensioning an emitter wire energizable to motivate ion flow;
positioning at least one conditioning surface of a carriage to frictionally engage the emitter wire and to, when transited along the emitter wire, deposit a conditioning material comprising silver on the frictionally engaged surface of the emitter wire; and
mechanically coupling the carriage to a drive mechanism operable, at successive times throughout the operating life of the electronic device product, to transit the conditioning surface along the emitter wire.

34. The method of claim 33 further comprising:

mechanically biasing the conditioning surface to elastic deform the emitter wire in correspondence with transit therealong.

35. The method of claim 33 further comprising:

electrically coupling the emitter wire and at least one collector electrode proximate thereto to opposing supply voltage terminals.

36. The method of claim 33, further comprising:

providing the tensioned emitter wire, the frictionally engaged conditioning surface and the mechanically coupled drive mechanism as an electrohydrodynamic (EHD) device subassembly-type electronic device product.

37. The method of claim 33, further comprising:

providing the tensioned emitter wire, the frictionally engaged conditioning surface and the mechanically coupled drive mechanism as an ion source subassembly-type electronic device product.

38. The method of claim 33, further comprising:

introducing an electrohydrodynamic (EHD) air mover device subassembly comprising the tensioned emitter wire, the frictionally engaged conditioning surface and the mechanically coupled drive mechanism into the electronic device product; and electrically coupling a power or thermal management system of the electronic device product to a controller operable to trigger the drive mechanism at the successive times throughout the operating life of the electronic device product.

39. The method of claim 33, wherein the electronic device product of an electrostatic printer or copier type, the method further comprising:

introducing an ion source subassembly comprising the tensioned emitter wire, the frictionally engaged conditioning surface and the mechanically coupled drive mechanism into the electrostatic printer or copier-type electronic device product; and electrically coupling a management system of the electrostatic printer or copier-type electronic device product to a controller operable to trigger the drive mechanism at the successive times throughout the operating life of the electrostatic printer or copier-type electronic device product.

40. The method of claim 33, wherein the conditioning material comprising silver includes one or more of elemental silver, an oxide of silver, an alloy of silver and an organometallic silver compound.

41. The method of claim 33, wherein the conditioning material comprising silver further includes graphite.

42. An apparatus comprising:

an electrohydrodynamic (EHD) fluid mover that includes emitter and collector electrodes energizable to motivate fluid flow therebetween; and a conditioning mechanism operable to, at successive times throughout the operating life of the apparatus, apply a consumable ozone catalyst to a surface of the emitter electrode.

43. The apparatus of claim 42, wherein the consumable ozone catalyst comprises silver.

44. The apparatus of claim 42, wherein the consumable ozone catalyst is applied via wearing of a solid material in frictional contact with the emitter during movement of at least one of the emitter electrode and the conditioning mechanism.

45. The apparatus of claim 42, wherein the consumable ozone catalyst is worn from one of a series of contours arranged to induce undulation in the emitter electrode during application of the consumable ozone catalyst.

46. The apparatus of claim 45, wherein at least one of the contours is defined by a blade comprising silver.

47. The apparatus of claim 42, wherein the conditioning mechanism further applies a conditioning material selected to at least partially mitigate at least one of emitter electrode surface erosion, corrosion, oxidation, silica adhesion, dendrite formation and mechanical adhesion of other detrimental material.

48. The apparatus of claim 42, wherein the conditioning mechanism includes at least one of a wiper, brush, squeegee and pad configured to remove detrimental materials built up on at least one of the electrodes.

49. The apparatus of claim 42, wherein the consumable ozone catalyst is applied on the emitter electrode in situ via movement of one of the conditioning mechanism and the emitter electrode.

50. The apparatus of claim 42, wherein the conditioning mechanism is configured to induce two or more undulations in the emitter electrode.

51. The apparatus of claim 42, wherein the conditioning mechanism is further operable to remove debris accumulated on the collector electrodes.

52. The apparatus of claim 42, wherein the emitter electrode is configured as an endless loop trained about a drive pulley.

53. The apparatus of claim 42, wherein the emitter electrode is configured to travel between a supply spool and a take-up spool.

54. The apparatus of claim 42, wherein the conditioning mechanism defines complementary surfaces for deflecting the emitter electrode into a controlled bend.

55. The apparatus of claim 54, wherein the complementary surfaces are configured to induce multiple undulations in the emitter electrode such that controlled bending stress in the emitter electrode contributes to break up brittle silica deposits on the emitter electrode.

56. The apparatus of claim 42, wherein the complementary surfaces themselves include undulations for inducing controlled bending stress in the emitter electrode to break up brittle silica deposits on the emitter electrode.

57. The apparatus of claim 42, wherein the conditioning mechanism includes a frictional cleaning surface engageable with the emitter electrode.

58. The apparatus of claim 57, wherein the frictional cleaning surface comprises a wearable material comprising silver.

59. The apparatus of claim 57, wherein the frictional cleaning surface comprises one of a wiper, blade, and pad comprising silver.

60. The apparatus of claim 42, wherein the conditioning mechanism comprises one or more surface profiles configured to provide frictional cleaning and deflection of the emitter electrode.

61. The apparatus of claim 42, wherein the emitter electrode and the collector electrodes constitute at least a portion of a thermal management assembly thermally coupled to a heat dissipating device in an electronic device.

62. A method for conditioning an electrode comprising:

operating an electrohydrodynamic (EHD) fluid mover that includes emitter and collector electrodes energizable to motivate fluid flow therebetween;

operating a conditioning mechanism at successive times between operation of the EHD fluid mover; and applying in situ, during the operating of the conditioning mechanism, a consumable ozone catalyst to a surface of the emitter electrode.

63. The method of claim 62, wherein the consumable ozone catalyst comprises silver.

64. The method of claim 62, wherein operating the conditioning mechanism includes transiting the emitter electrode in frictional contact with a wearable cleaning surface comprising the consumable ozone catalyst.

65. The method of claim 62, wherein operating the conditioning mechanism includes transiting a wearable cleaning surface comprising the consumable ozone catalyst in frictional contact with the emitter electrode.

66. The method of claim 62, further comprising:

moving at least one of the conditioning mechanism and the emitter electrode to thereby remove detrimental material from the emitter electrode.

67. The method of claim 62, further comprising:

applying a conditioning material selected to at least partially mitigate at least one of emitter electrode surface erosion, corrosion, oxidation and dendrite formation.

68. The method of claim 62, wherein the conditioning material includes at least one of silver, palladium, platinum, manganese, nickel, zirconium, titanium, tungsten, aluminum, and a respective oxide or alloy thereof.

69. The method of claim 62, wherein applying the consumable ozone catalyst is performed when the emitter electrode is not energized.

70. The method of claim 62, wherein the applying is initiated by a controller based upon one or more of an imposed voltage level, a measured electrical potential, determination of the presence of a level of contamination by optical means, detection of an event and detection of a performance parameter.

71. The method of claim 62, further comprising:

elastically deforming the emitter electrode to remove undesirable material accumulated on the surface thereof.

72. The method of claim 62, wherein the consumable ozone catalyst is applied on the electrode in situ via movement of one of the cleaning device and the electrode with respect to the other under control of a drive mechanism.

* * * * *